US011351540B2

(12) United States Patent
Temiz et al.

(10) Patent No.: US 11,351,540 B2
(45) Date of Patent: Jun. 7, 2022

(54) COVERT CODES BASED ON ELECTRICAL SENSING OF PATTERNED MATERIALS IN MICROFLUIDIC DEVICES

(71) Applicant: International Business Machines Corporation, Armonk, NY (US)

(72) Inventors: Yuksel Temiz, Zug (CH); Onur Gökçe, Zurich (CH); Elisa Hemmig, Liestal (CH); Emmanuel Delamarche, Thalwil (CH)

(73) Assignee: International Business Machines Corporation, Armonk, NY (US)

( * ) Notice: Subject to any disclaimer, the term of this patent is extended or adjusted under 35 U.S.C. 154(b) by 353 days.

(21) Appl. No.: 16/152,173

(22) Filed: Oct. 4, 2018

(65) Prior Publication Data

US 2020/0108385 A1 Apr. 9, 2020

(51) Int. Cl.
*B01L 3/00* (2006.01)

(52) U.S. Cl.
CPC ... *B01L 3/502715* (2013.01); *B01L 2200/027* (2013.01); *B01L 2200/141* (2013.01); *B01L 2300/021* (2013.01); *B01L 2300/023* (2013.01)

(58) Field of Classification Search
CPC ..... B01L 2200/027; B01L 2200/141; B01L 2300/021; B01L 2300/023
See application file for complete search history.

(56) References Cited

U.S. PATENT DOCUMENTS 9,149,806 B2 10/2015 Collins et al.
2004/0189311 A1* 9/2004 Glezer ..... G01N 33/5438 324/444
2014/0017709 A1 1/2014 Lowe et al.
2017/0297022 A1 10/2017 Putnam et al.

FOREIGN PATENT DOCUMENTS

WO 2017/077409 A 5/2017

OTHER PUBLICATIONS

Gökçe, Onur, Cristina Mercandetti, and Emmanuel Delamarche. "High-content optical codes for protecting rapid diagnostic tests from counterfeiting." Analytical chemistry 90.12 (2018): 7383-7390. (Year: 2018).*

(Continued)

*Primary Examiner* — Robert J Eom
(74) *Attorney, Agent, or Firm* — Daniel Morris; Otterstedt, Wallace & Kammer, LLP

(57) ABSTRACT

A microfluidic device includes a surface, which defines a flow path for a liquid, and a liquid inlet, which is in fluid communication with said surface, so as for a liquid introduced via the inlet to advance along a propagation direction on the flow path. Also included are a set of two or more electrical contacts, and a set of electrodes which include sensing portions that extend across the flow path, transversally to the propagation direction. The electrodes are connected to the two or more electrical contacts. Also included are material spots on at least some of the sensing portions of the electrodes. Still, material spots of a same material are only on a subset of the sensing portions of the electrodes, so that the spots can alter an electrical signal detected from the electrical contacts, upon a liquid advancing along the flow path, in operation of the device.

23 Claims, 11 Drawing Sheets

(56) References Cited

OTHER PUBLICATIONS

Zou, Zhiwei, et al. "Functionalized nano interdigitated electrodes arrays on polymer with integrated microfluidics for direct bio-affinity sensing using impedimetric measurement." Sensors and Actuators A: Physical 136.2 (2007): 518-526. (Year: 2007).*

Liu et al., Microfluidic Codes: A Scalable Multiplexed Electronic Sensor for Orthogonal Detection of Particles in Microfluidic Channels, Lab on a Chip 16.8 (2016): 1350-1357, URL: https://www.ncbi.nlm.nih.gov/pubmed/27021807.

Irena Barbulovic-Nad et al., Cell Assays in Microfluidics, Encyclopedia of microfluidics and nanofluidics. Springer, Boston, MA, 2008. 209-216.

* cited by examiner

COVERT CODES BASED ON ELECTRICAL SENSING OF PATTERNED MATERIALS IN MICROFLUIDIC DEVICES

BACKGROUND

The invention relates in general to the field of microfluidics and, in particular, to microfluidic devices embedding security or validation features, as well methods to embed and read such features.

Microfluidics deals with the operation of fluids at small scale. Prominent features of microfluidics originate from the peculiar behavior that liquids exhibit at sub-milliliter scales, i.e., in the micrometer range, where liquid flows are typically laminar. Microfluidics generally rely on microfabricated devices that are typically designed for pumping, sampling, mixing, analyzing and dosing liquids. Volumes well below one nanoliter can be reached by fabricating shallow structures with lateral dimensions in the micrometer range. In particular, reactions that are limited at large scales (by diffusion of reactants) can be accelerated.

Many microfluidic devices have user chip interfaces and closed flow paths. Closed flow paths facilitate the integration of functional elements (e.g., heaters, mixers, pumps, UV detector, valves, etc.) into one device while minimizing problems related to leaks and evaporation. The analysis of liquid samples often requires a series of steps (e.g., filtration, dissolution of reagents, heating, washing, reading of signal, etc.). Metallic electrodes are sometimes patterned in channels of the device, e.g., for the detection and/or analysis of liquid samples or specific reagents therein.

Microfluidics has opened the door for novel applications in various areas of healthcare and life sciences, such as rapid diagnostic tests (RDTs), environmental analysis, and drug discovery. RDT devices are used for quick and easy medical diagnostic tests. They typically allow results to be obtained within a few hours or less. They notably include point-of-care test devices (POCDs) and over-the-counter (OTC) tests.

Point-of-care testing is also referred to as bedside testing. POCDs allow medical diagnostic testing at or near the point of care, e.g., at the time and place of the patient care. OTC tests are similar devices. They are, however, typically simpler than POCDs and can often be purchased in pharmacies for people to perform the test themselves, e.g., at home or away from healthcare settings and without assistance from healthcare staff. POCDs strongly benefit from microfluidic technologies due to the miniaturization of tests, which enhances portability and the integration of various functions into one diagnostic device.

RTDs are typically portable, e.g., handheld devices, easy to use, low cost to manufacture, and fast. They are therefore considered an essential technology by the World Health Organization (WHO) for combatting infectious diseases, amongst others, and improving health in countries where such diseases are endemic. OTC devices are frequently used for monitoring therapy (e.g., to ensure appropriate doses of blood anticoagulant drugs), for monitoring glucose in blood, or for detecting drugs of abuse in body fluids.

The most widely used diagnostic devices are perhaps the so-called "lateral flow assays", which rely on a stripe of cellulose along which a sample flows and reacts with reagents. Such devices are also called strip tests and are typically provided in the form of sticks to be dipped into a liquid to perform the test. If analytes are present in the sample, a colored signal appears on the stripe. Such tests are used to detect malaria, hepatitis virus, HIV, biomarkers related to heart failure, etc. Still, many lateral flow assay tests rely on microfluidic functions and microfabrication to increase their precision and multiplexing capabilities. And besides diseases, test devices are commonly used to detect a specific condition, such as pregnancy or ovulation.

There has been numerous reports and alerts on RTDs being counterfeited or inappropriately sold. For instance, several sources have reported that counterfeited tests had been sold for diagnosing Leishmaniasis. In addition, fake pregnancy tests, fake tests for glucose monitoring and fake human immunodeficiency virus (HIV) test kits (originally designed to test for pregnancy or other conditions) have reportedly been sold, amongst other frauds.

The WHO estimates that counterfeiting of tests compromises the detection, surveillance and eradication of some diseases. This is particularly worrying for large-scale infectious diseases as the latter typically need concerted and global surveillance. The programs of prevention, treatment, detection, and eradication that are developed to combat such diseases sometimes require concerted efforts between several countries. They typically involve heterogeneous types of patients and healthcare settings (e.g., itinerant outpost vs. hospital). Task forces have been setup to provide recommendation and raise awareness on the problem of counterfeiting of medical products. They typically focus on counterfeited drugs and gives useful recommendations on common approaches for adding security features to medical product packages. Unfortunately, such security features are frequently breached in practice.

SUMMARY

According to a first aspect, the present invention is embodied as a microfluidic device. The device notably comprises a surface, which defines a flow path for a liquid, and a liquid inlet, which is in fluid communication with said surface, so as for a liquid introduced via the liquid inlet to be able to advance along a propagation direction on the flow path. The device further comprises a set of two or more electrical contacts, and a set of electrodes. The electrodes include sensing portions that extend across the flow path, transversally to the propagation direction of the liquid, in operation. The electrodes are connected to the two or more electrical contacts. In addition, the device further comprises material spots on at least some of the sensing portions of the electrodes. Still, material spots of a same material are only on a subset of the sensing portions of the electrodes, so as to alter an electrical signal detected from the electrical contacts, upon a liquid advancing along the flow path, in operation of the device.

On the one hand, the signal detected is altered over time, owing to the liquid advancing along the flow path and contacting the sensing portions of the electrodes. On the other hand, the pattern of the material spots impacts the way the signal is altered and when it is altered, or not. The pattern formed by the spots can thus be used to embed a code, which is retrieved by reading the altered signal, in operation of the device. The above device can thus advantageously be used for security and/or validation applications, e.g., for protecting microfluidic-based diagnostic devices against counterfeiting and/or for medication adherence purposes, for example. The electrodes and spots may for instance be implemented in an auxiliary microfluidic channel (e.g., a side channel, parallel to a main microfluidic channel used for the actual diagnostics) or in the main channel but downstream the test area, in order to prevent adverse effects on the diagnostic test.

In embodiments, subsets of one or more of said sensing portions are arranged at regular intervals along the flow path, in order to ease extraction of time-dependent information contained in the altered signal.

In a first class of embodiments, sensing portions of the set of electrodes are connected to respective ones of said electrical contacts, and each of the material spots coats a respective one of the sensing portions. This approach allows a large number of measurements to be performed between pairs of sensing portions of electrodes; it does not request to measure transient changes and does further not necessarily require a calibration of the liquid flow rate.

In a second class of embodiments, sensing portions of the set of electrodes are arranged in pairs, each connected to a same pair of electrical contacts of said two or more electrical contacts. That is, two sensing portions of each of the pairs of electrodes are connected to respective electrical contacts of that same pair of electrical contacts. Moreover, each of the material spots coats the two sensing portions of a respective one of the pairs of electrodes in that case. This makes it possible to detect successive increases in a cumulative capacitance signal, for example, based on which an embedded code can be retrieved. Such a design leads to unexpectedly clean and distinct increments in the single signal measured (no multiplex signal is needed), while only requiring two electrical contacts, irrespective of the number of electrode pairs. Preferably, the sensing portions decompose into two subsets, wherein two sensing portions of each of the pairs belong to distinct ones of the two subsets. There, for each of the two subsets, sensing portions of said each of the two subsets branch from a common electrode part, the latter arranged outside the surface defining the flow path and connected to one of said two or more electrical contacts. Such a concept is easily scalable, even to complex designs involving parallel flow path sections.

In embodiments, said pairs of sensing portions form an arrangement of successive pairs along the flow path and an upstream subset of one or more of the pairs of this arrangement (the closest to said liquid inlet with respect to the flow path), are not coated by any material spot, to allow calibration of the signal sensed.

Preferably, the device comprises additional sets of electrodes and electrical contacts. That is, beyond said set of two or more electrical contacts (call it a first set of two or more electrical contacts) and said set of electrodes (a first set of electrodes), the device may further comprise a second set of electrical contacts and a second set of electrodes, whose electrodes are connected to contacts of the second set of contacts but are otherwise arranged so as not to interfere, electrically, with the first set of electrodes on the microfluidic device. The second set of electrodes comprise bent portions extending across the flow path and transversally to said propagation direction, upstream respective ones of said pairs of sensing portions. This makes it possible to detect timings of a liquid reaching the pairs of sensing portions of the first set of electrodes. This feature can be particularly useful if the flow rate is not uniform (e.g., due to an increase in the hydraulic resistance while the liquid advances in the channel) and/or shows chip-to-chip variations.

In preferred embodiments, the flow path comprises several flow path sections, each comprising: a trigger channel; a main channel, leading to said trigger channel; a set of areas, across which extend the sensing portions of a respective one of the pairs, each of the areas branching from the main channel; and a bypass channel. The latter branches from the main channel upstream any area of the set of areas with respect to the liquid inlet. The bypass channel leads to a junction between the main channel and the trigger channel of a next flow path section, the latter arranged downstream said each of the flow path section with respect to the liquid inlet. The junction forms a trigger valve designed such that liquid at the junction can fill the main channel of the next flow path section only if the adjoining trigger channel is already filled with liquid. The junctions allow improved control on the progression of the liquid and thereby helps in maintaining a constant flow rate.

Preferably, the device comprises a layer of material processed so as to define, at least partly, a microchannel, and said surface is a bottom wall of the microchannel.

In embodiments, said material spots of the same material comprise spots that are insoluble in a given target liquid. In fact, the device may possibly comprise, on the one hand, spots that are soluble in a given liquid and, on the other hand, spots that are not soluble in said given liquid. Soluble spots can be used to conceal the code captured by the insoluble spots.

In preferred embodiments, the sensing portions of the electrodes extend, each, over an entire width of the surface defining said flow path, said width measured parallel to the surface and perpendicular to the propagation direction of the liquid at the level of said sensing portions.

Preferably, said at least some of the sensing portions are, each, entirely coated by respective material spots thereon.

In embodiments, the device further includes one or more peripheral units connected to two or more of said electrical contacts and configured to detect said signal and derive said code.

According to another aspect, the invention is embodied as a method of operating a microfluidic device. This method relies on a microfluidic device as described above, i.e., including a surface that defines a flow path, a set of two or more electrical contacts, and a set of electrodes including sensing portions extending across the flow path, transversally to the propagation direction, wherein the electrodes are connected to the two or more electrical contacts. The device further includes material spots on at least some of the sensing portions. Yet, material spots of a same material are only on a subset of the sensing portions. According to this method, a liquid is introduced in the device for the liquid to advance along the flow path. An electrical signal is detected from the electrical contacts. The signal detected is altered over time by the liquid advancing along the flow path and contacting the sensing portions of the electrodes and the distribution of spots of a same material impacts the way the signal is altered. Finally, a code is derived from the altered electrical signal detected.

In preferred embodiments, the method further comprises instructing computerized means to automatically compare data corresponding to the code derived with some reference data, e.g., for validation or security purposes.

Preferably, a "dry" signature is detected, prior to introducing the liquid. That is, the method further comprises (prior to introducing the liquid) detecting a first electrical signal from the electrical contacts and deriving a first code from the first electrical signal detected. Then, after having derived the (second) code from the (second) electrical signal detected, the method may further comprise instructing computerized means to automatically compare data corresponding to the first code derived with one or each of the second code and said reference data.

In embodiments, the method further comprises converting the signal detected into a time-dependent capacitance. Preferably, the signal detected is converted into a time-dependent, cumulative capacitance. In that case, the code may be derived based on local extrema located in the cumulative capacitance. In practice, the derivative of the cumulative capacitance signal may for instance reveal instances corresponding to capacitance changes due to an electrode pair that is not covered with an insoluble material spot.

In preferred embodiments, sensing portions of the set of electrodes are connected to respective ones of said electrical contacts, and each of the material spots coats a respective one of the sensing portions. Electrical signals are thus detected from said respective ones of said electrical contacts, so as to detect changes in respective, time-dependent capacitance signals (e.g., multiplex signals). The code is simply derived from the changes detected for each of the capacitance signals.

Preferably, however, sensing portions of the set of electrodes are arranged in pairs, which are all connected to the same pair of contacts. That is, two sensing portions of each of the pairs of electrodes are connected to respective electrical contacts of said same pair of contacts. In that case, each of the material spots coats the two sensing portions of a respective one of the pairs of sensing portions and the electrical signal is detected from said same pair of electrical contacts, so as to detect incremental increases in a time-dependent capacitance. The code is finally derived from the detected incremental increases in the capacitance.

In embodiments, said pairs of sensing portions form an arrangement of successive pairs in the device provided. An upstream subset of one or more of the pairs of this arrangement (the closest to the liquid inlet of the device with respect to the flow path) is not coated by any material spot, for calibration purposes. Namely, the method may further comprise, while detecting said electrical signal, extracting properties of the liquid advancing on the flow path based on the signal detected via said subset of one or more of the pairs, to calibrate said incremental increases in the capacitance. The code is subsequently derived based on the calibrated incremental increases. In variants, however, additional electrode pairs can be used to extract the timing information (e.g., the flow rate), such that those calibration electrodes may not be required.

According to still another aspect, the invention is embodied as a method of conditioning a microfluidic device, i.e., a method of bringing a microfluidic device into a desired state for use. This additional method again relies on a microfluidic device that includes a surface, a set of electrodes and electrical contacts as described above. The conditioning method basically revolves around depositing material spots on at least some of the sensing portions of the electrodes. Still, material spots of a same material should only be on a subset of the sensing portions, which subset is selected according to a given code, consistently with the present devices and methods of operation thereof. I.e., the code selected is translated into a pattern, according to which said material spots are patterned. Again, the pattern(s) formed by the material spots deposited impact the way an electrical signal detected from the electrical contacts is altered upon a liquid advancing along the flow path, in operation of the device.

In preferred embodiments, the material spots deposited comprise, on the one hand, spots that are soluble in a given liquid and, on the other hand, spots that are not soluble in said given liquid.

Preferably, said sensing portions form, in the device provided, an arrangement of successive parts, and at depositing said material spots, no material spot is deposited on any sensing portions of an upstream subset of the sensing portions of said arrangement.

Devices, systems and methods embodying the present invention will now be described, by way of non-limiting examples, and in reference to the accompanying drawings.

BRIEF DESCRIPTION OF THE DRAWINGS

The accompanying figures, where like reference numerals refer to identical or functionally similar elements throughout the separate views, and which together with the detailed description below are incorporated in and form part of the present specification, serve to further illustrate various embodiments and to explain various principles and advantages all in accordance with the present disclosure, in which:

FIG. 4A depicts the layout after having patterned the electrodes but prior to introducing a liquid. FIG. 4B shows the same layout after introducing the liquid, which advances along the flow path. In this example, the code can be retrieved from signals measured between pairs of the electrical contacts, as in embodiments.

Figure 1:
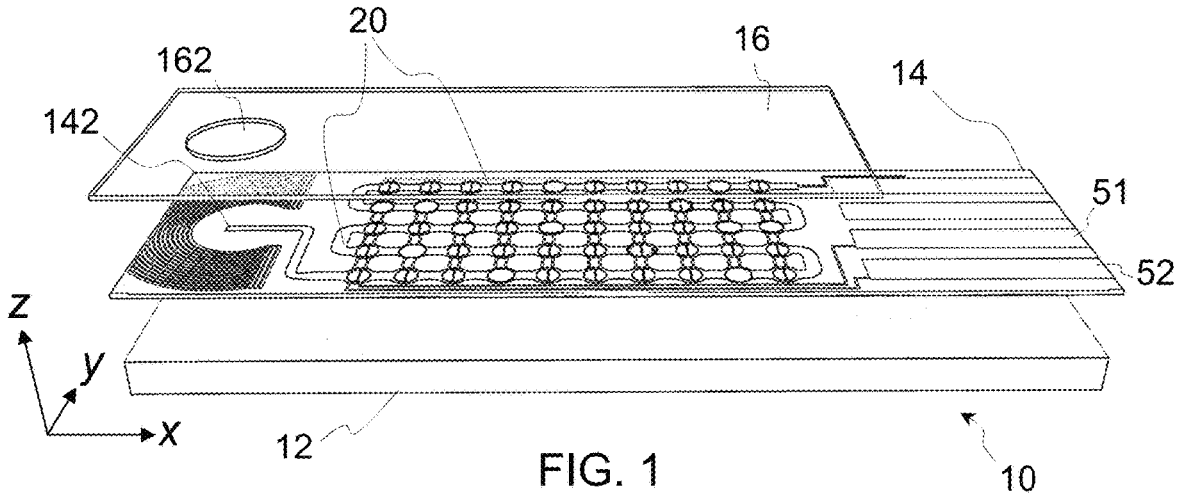
FIG. 1 is a 3D, exploded view of a microfluidic device according to embodiments.

The accompanying drawings show simplified representations of devices or parts thereof, as involved in embodiments. Technical features depicted in the drawings are not necessarily to scale. Similar or functionally similar elements in the figures have been allocated the same numeral references, unless otherwise indicated.

DETAILED DESCRIPTION

The following description is structured as follows. First, general embodiments and high-level variants are described (sect. 1). The next section addresses more specific embodiments and technical implementation details (sect. 2).

1. General Embodiments and High-Level Variants

In reference to FIGS. 1-5 and 10-12, an aspect of the invention is first described, which concerns a microfluidic device 10, 10*a*-10*g*.

This device notably comprises a surface 20, which defines a flow path for a liquid L, as well as a liquid inlet 142, 162. The inlet is in fluid communication with the surface 20: a liquid L introduced via the liquid inlet 142, 162 will thus be able to advance on the flow path, along a propagation direction defined by the flow path, as simply illustrated in FIG. 2 or 4. The surface 20 that defines the flow path is preferably a wetting surface for the target liquid L (typically an aqueous liquid), such that the liquid progression will simply be driven by capillarity. In that respect, the device may further comprise one or more capillary pumps (not shown) arranged along and/or downstream the flow path, if necessary. Yet, the surface 20 need not necessarily be wetting for the target liquid L. I.e., the liquid may be forced onto the flow path, e.g., using active pumping means, for example. Note, the surface 20 is typically formed in a microchannel, e.g., as a bottom surface thereof. Thus, the flow path may actually be defined by several adjoining surfaces of this channel, including a bottom surface, lateral surfaces and possibly a top surface, as usual in the art.

The device may for instance comprise a wafer 14, whereon microchannels are grooved. The resulting grooves may need be passivated to form wetting surfaces. The wafer 14 may possibly be mounted on a thicker substrate 12, to provide mechanical resistance, if needed, and can be capped with a lid 16 to close the microchannels, as assumed in FIG. 1. The lid may for instance includes an aperture 162 to introduce the liquid and vents (not shown), to flush the air compressed by the liquid advancing inside the closed channels. In variants, the flow path may be primarily subtended by a wall formed by a layer of dielectric material that covers a grooved substrate.

Figure 2A:
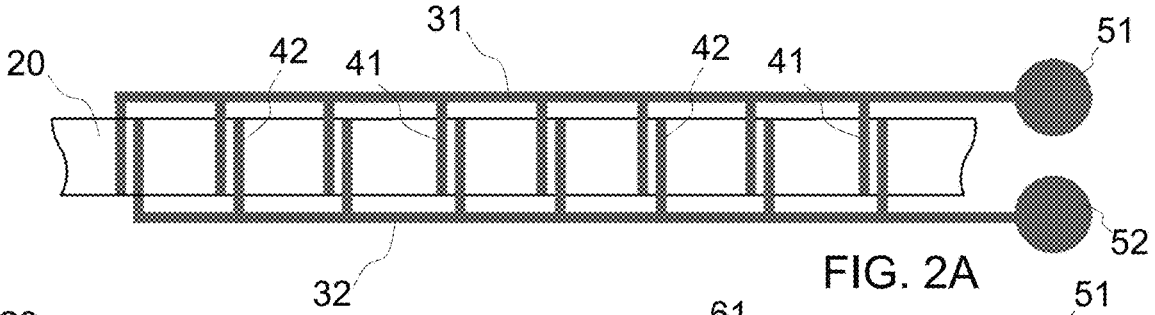
FIGS. 2A, 2B, and 2C show top views of a (simplified) layout of electrodes and flow path of a device as in FIG. 1, prior to depositing material spots on electrodes (FIG. 2A), prior to introducing a liquid (FIG. 2B), and after introducing the liquid, which advances along the flow path (FIG. 2C), as in embodiments.
Figure 2B:
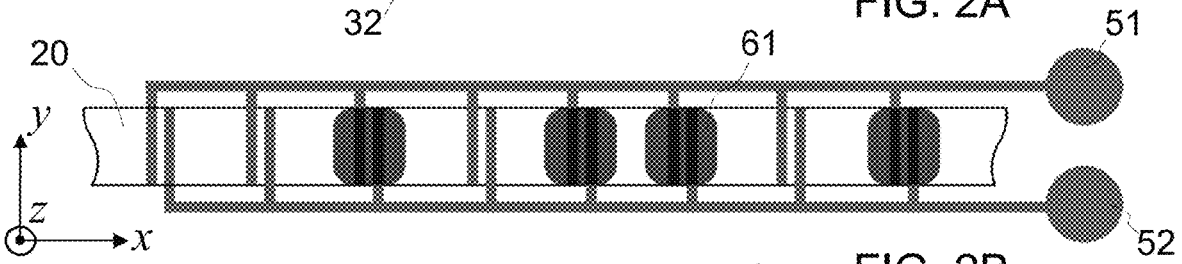
Figure 2C:
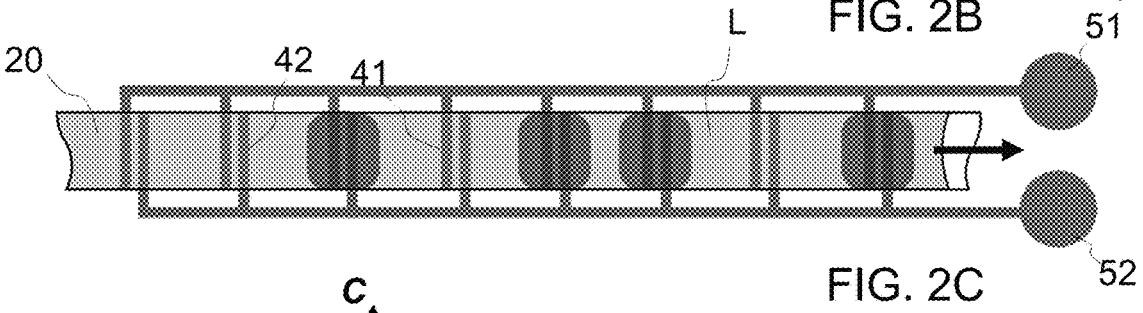

The device further includes a set of two or more electrical contacts 50-52, and a set of electrodes 31, 32, 40-42. The electrodes may have a more or less sophisticated layout on the device, as exemplified later. In all cases, they include sensing portions 40-42, which are assumed to be end parts of the electrodes in the examples of FIGS. 2 and 4, though this need not necessarily be the case. Indeed, in a more sophisticated electrode layout, inner portions of a conductor could serve as sensing parts, as assumed in FIGS. 1, 5, 11 and 12. In all cases, the sensing portions extend across the flow path and transversally to the propagation direction of the liquid at the level of the sensing portions. The sensing portions 40-42 of the electrodes may possibly branch from/to a common conductor 31, 32, as best seen in FIG. 2A. In all cases, the electrodes are connected to two or more of the electrical contacts 50-52, to allow measurements.

Importantly, material spots 61, 62 are formed on at least some of the sensing portions 40-42 of the electrodes. A spot of material is a small mark obtained from a material differing in electrical conductivity (and possibly in color and/or texture) from the surface 20 around it. The spots 61, 62 may stem from different materials (e.g., insoluble or not in the target liquid L), typically having distinct conductivities. Yet, in all cases, material spots 61, 62 of a same material (e.g., the insoluble material 61 or the soluble material 62) are formed only on a subset of the sensing portions 40-42 of the electrode.

The presence or absence of such spots 61, 62 impacts (i.e., modulates) the electrical signal detected from the electrical contacts 50-52, upon the liquid L advancing along the flow path, in operation of the device. Namely, the progression of the liquid sequentially impacts the signals measured between pairs of electrodes. But the extent in which the liquid alters the signal read depends on whether electrodes are coated (and thus bypassed) by the material spots 61, 62 and the nature (soluble, insoluble, well conducting, poorly conducting, etc.) of the material(s) the spot(s) 61, 62 is(are) made of.

In more details, the sensing portions or parts 40-42 of the electrodes are portions extending across the flow path, so as to potentially sense the liquid that comes to contact the sensing portions (e.g., via a double-layer capacitance signal). The uncoated (i.e., spot-free) sensing portions 40-42 of the electrodes, if any, are exposed to the liquid L advancing along the flow path. On the contrary, the other sensing portions (on which spots 61, 62 are deposited) are at most partly exposed to the liquid L or possibly not exposed at all, depending on how the spots are formed thereon, which impacts the signal read. Note, independently from the spots 61, 62, the electrode sensing portions 40-42 are preferably naked electrodes, i.e., not passivated, to allow a better sensing of the liquid. In that respect, we note that the double-layer capacitance that appears at the liquid-electrode interface is typically higher than the capacitance of electrodes with a dielectric passivation. Other electrode portions (those portions that are not meant to be exposed to the liquid, because they are located outside of the flow path) could, however, be passivated, though this is typically not necessary.

The material spots 61, 62 and the sensing portions 40-42 of the electrodes are designed in such a manner that a liquid L advancing along the flow path is able to cross the sensing portions 40-42, together with a material spot thereon, if any. For example, the sensing portions 40-42 may be made flush with the surface 20 defining the flow path (or with any neighboring surface forming part of the microchannel, for example), as otherwise discussed in sect. 2. In variants, thin sensing portions 40-42 may be patterned as metal strips on top of a surface of the microchannel. Yet, such metal strips should be sufficiently thin, in order not to stop or substantially slow down the liquid progression. Similarly, the material spots 61, 62 will typically be too thin to measurably impact the liquid flow rate. In case the microfluidic device uses capillary forces to drive the liquid flow, the material spots should typically be sufficiently hydrophilic (or not too hydrophobic), so as not to impair the liquid progression (the liquid can still advance).

Thanks to the above device, an electrical signal (e.g., capacitance, impedance of electrochemical) can be read, which is altered over time as liquid L progresses along the flow path. Alterations of the signal are not only determined by the liquid progression but also by the absence or presence of the material spots 61, 62 at the level of the sensing portions 40-42. The pattern formed by the spots 61, 62 reflects a code, which is retrieved by reading the altered signal. The above device can thus advantageously be used for validation and/or security purposes, e.g., for protecting microfluidic-based diagnostic devices against counterfeiting and/or for medication adherence purposes. For security applications, the pattern of spots may be used to encode bits of information (as assumed in FIGS. 2D and 5C). For medication adherence applications, a specific sign code or message may be decoded via the altered signal read, in order to confirm whether a drug was taken and at the right dose, for example. The present devices are compatible with many chemical systems and are all the more advantageous where electrodes are anyway needed to perform the primary test or assay enabled by the devices, as further discussed in sect. 2.

The patterned spots allow information to be encoded, for example a security key or any security-related data, fabrication batch id, and/or other detectable information. The present approach allows information to be encoded directly on the microfluidic device, which is harder to imitate or fake, and may thus be useful to detect fake or counterfeited tests or signalize fraudulent tests, e.g., tests which have already used. The patterns of spots may be used in conjunction with other security features on the packaging, e.g., as a confirmation key. The present solutions are perceived to be more satisfactory than solutions relying on security features placed on the sole test packages as the latter can be more easily infringed or faked.

For example, a security key may be spotted directly on the device, to add a technical barrier and discourage counterfeiters. Ideally in such a case, each single test should have an individual security key and the key should be well defined, easy to read and digitalize, e.g., by patterning spots of ink, to obtain the desired pattern.

The sensing portions of the electrodes may be end portions (as in FIGS. 2, 4) or intermediate (inner) portions (FIGS. 11, 12) of the electrical conductors forming the electrodes. As illustrated in FIGS. 2, 4, 5, 11, and 12, the sensing portions 40-42 of the electrodes preferably extend, each, over the entire width of the respective sensing area provided on the surface 20. The "width" of the surface 20 is measured parallel to the surface and perpendicular to the propagation direction of the liquid at the level of the sensing portions. This amounts to maximize and thus uniformize the extension of the sensing portions over the (normally constant) width of the sensing area, which makes it possible to achieve cleaner and more easily interpretable signals in practice. This, in turn, eases the subsequent retrieval of the code. Incidentally, the surface may possibly be designed so as to locally form enlarged sensing areas, as in FIGS. 1, 5, 10 and 11, to increase the magnitude of the signal sensed and thus improve the signal-to-noise ratio. Such sensing areas will normally form opening angles (non-pining edges) that favor the liquid progression and allow a homogeneous filling of the liquid.

Consistently, the material spots 61, 62 will preferably coat entirely the sensing portions 40-42, as seen in FIGS. 2, 4, 5 and 10B. For example, the material spots may be applied as insoluble or soluble ink with a marker, so as to cover an area that exceed the sensing area delimited by the local contours of the surface 20. This makes sure that the sensing area is entirely coated, locally. This way, the sensing portions 40-42 do not have residual portions exposed to the liquid L, which results in more uniform detection characteristics. This, eventually, allows cleaner signals to be obtained and thus simplifies the code retrieval. In case of a diagnostic device, such electrodes are preferably placed downstream the functional areas used for the test or in a parallel (auxiliary) microfluidic channel to minimize the impact of electrodes and ink on the test performance.

Various geometries and dimensions can be contemplated for the sensing portions of the electrodes, as illustrated in FIGS. 9A-9F. The upper drawings show the naked electrodes, whereas the lower depictions show the coated electrodes, after spotting. While a straight electrode pair (FIG. 9A) will normally provide a satisfactory signal is most situations, the electrode geometry may be adapted, for specific applications. For example, circular pairs (FIG. 9B, 9C) may improve the magnitude of the signal, especially where a double-layer capacitance is detected, and may facilitate the spotting process in case an inkjet spotter is used. Still, the geometry of FIG. 9E may prove more suitable for the detection of an electrochemical signal, whereas other geometries (e.g., FIG. 9D, 9F) can be considered to increase the effective electrode area or minimize the electrical resistance between two electrodes.

As further seen in FIGS. 2, 4, 5, and 10-12, the sensing portions 40-42 are preferably arranged at regular intervals along the flow path or parallel sections thereof (see, e.g., FIG. 4), to ease extraction of time-dependent information. In fact, the sensing portions may possibly be arranged in pairs, which are themselves arranged at regular intervals along the flow path or sections thereof, as best seen in FIGS. 2A-2C. Thus, each sensing portion or pairs of sensing portions can form a regular pattern. More generally, subsets formed by one or more of the sensing portions 40-42 can be arranged at regular intervals along the flow path (see also FIGS. 10-12). As noted above, the shape of the flow path may in fact require distinct flow path sections, in which sensing portions are arranged at regular intervals, while the gaps between the various sections may differ from the gaps within a given section, as for example illustrated in FIG. 5A, showing a meandering flow path.

Various mapping between the electrode sensing portions 40-42 and the electrical contacts 50-52 can be contemplated, depending on the type of signals one wishes to measure, as exemplified below. Essentially two classes of mapping are contemplated herein.

Figure 4A:
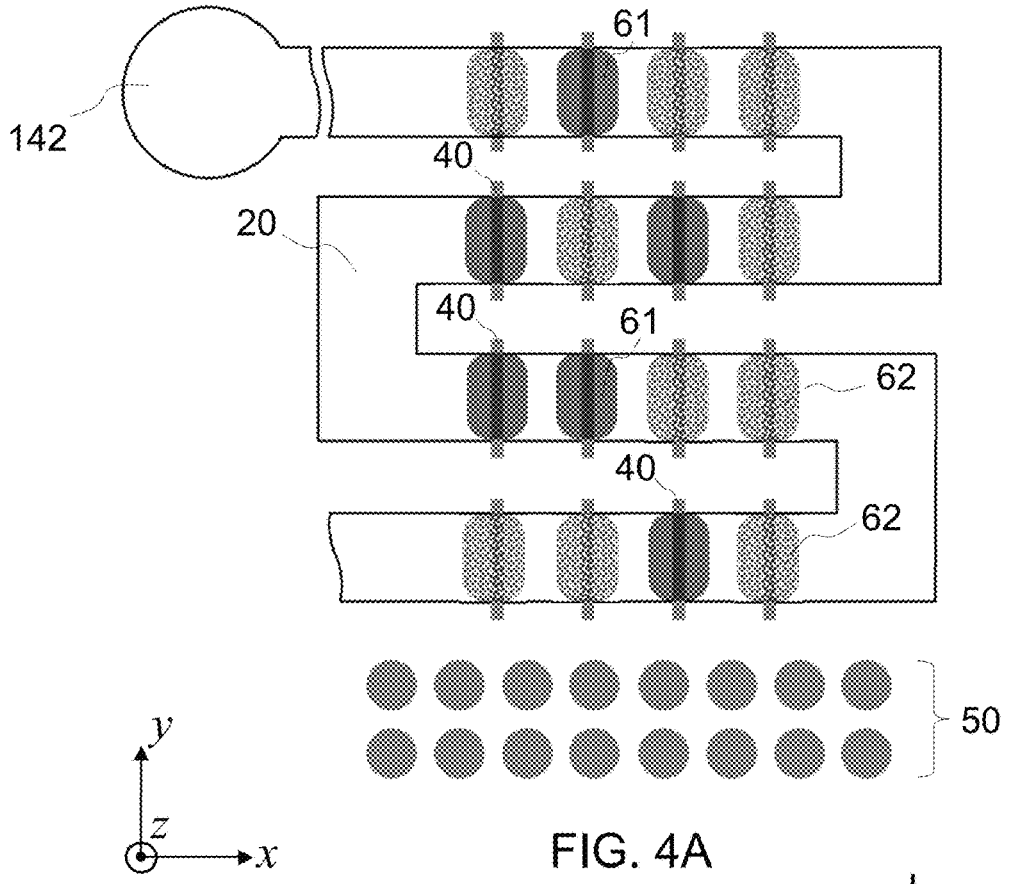
FIGS. 4A and 4B show top views of another (simplified) layout of electrodes and flow path, where sensing parts of the electrodes are connected (not shown) to respective electrical contacts.
Figure 4B:
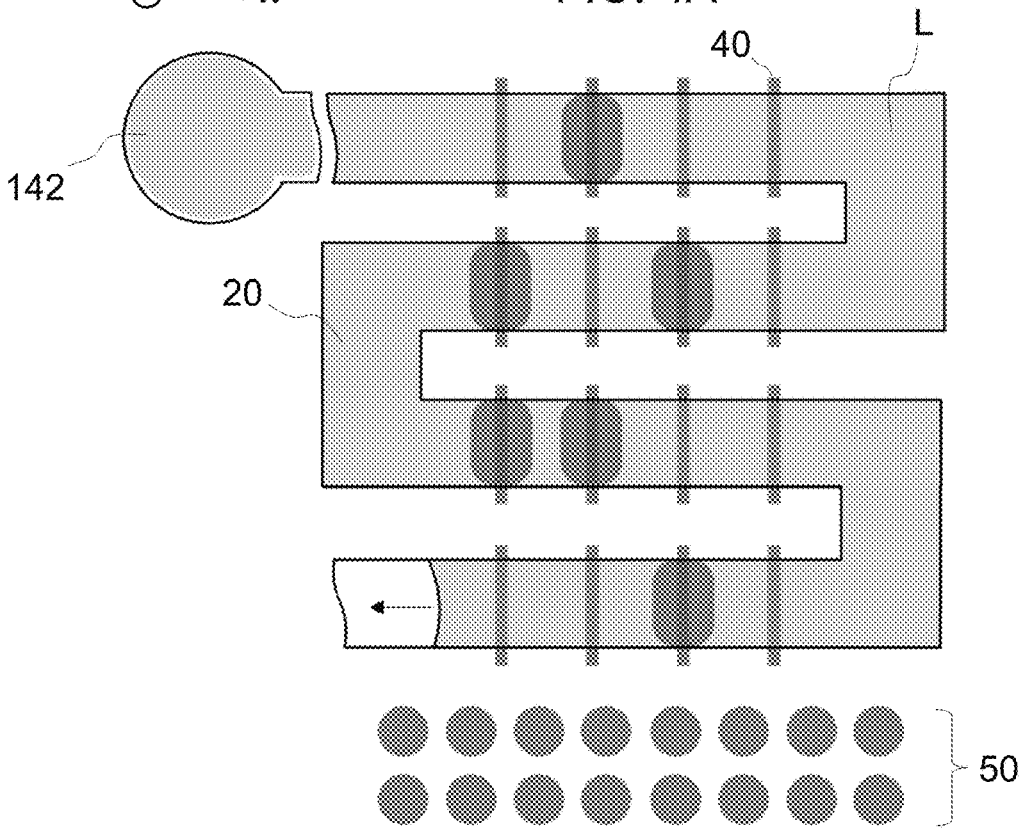

A first class involve a mere one-to-one mapping, as exemplified in FIGS. 4A, 4B. Here, sensing portions 40 of the set of electrodes are connected to respective electrical contacts 50 (though the actual connections are not depicted, for concision). Meanwhile, each material spot 61, 62 coats a single sensing portions 40. This makes it notably possible to detect changes in capacitance signals measured between selected pairs of the electrodes, based on which a code can be retrieved. The pairs of electrodes are selected from the corresponding pairs of contacts 40. Here too, the sensing portions 40 of the electrodes can be arranged at regular intervals. This, however, is not critical to extract time dependent information because signals from the electrode pairs are measured independently from each other. This implementation can be particularly interesting if the microfluidic flow path of the diagnostic device is configured as a wide liquid chamber, rather than a narrow flow path (e.g., for applications to electrochemical blood glucose tests).

In other words, a spot 61, 62 coats a single sensing portion 40. Even if all sensing portion 40 can be coated by material spots 61, 62, as in the example of FIG. 4A, spots of a same material (e.g., the insoluble spots 61) coat only a subset of the sensing portions 40. The remaining sensing portions may be coated by spots 62 of a different material (assumed to be soluble spots in FIG. 4), or not coated at all. Importantly, one sensing portion 40 (an end portion) of an electrode is connected to a single, respective contact 50 in this case.

Only one type of material (e.g., an insoluble material 61) could be used, contrary to the example of FIG. 4A. Yet, both soluble and insoluble spots are preferably used, for example to conceal the code embedded in the pattern formed by the insoluble spots 61. Indeed, soluble and insoluble spots could well be optically similar, although leading to distinct results, electrically speaking. We note that the notion of soluble vs. insoluble spot is a relative notion. In the present document, an "insoluble spot" is a spot of a material that will not substantially solubilize in the liquid flow during the period of time necessary for the measurements to take place, which corresponds to the time needed for the liquid to cross all the sensing parts. I.e., an insoluble spot forms an electrical passivation. On the contrary, a "soluble spot" will substantially solubilize in the advancing liquid, during the period of time necessary for the liquid to cross one or more of the sensing parts, as otherwise illustrated in FIG. 3. That is, a soluble spot results in a change in the electrical signal measured.

While soluble spots 62 can advantageously be used to conceal the code embedded via the pattern of insoluble material spots 61 (which makes it harder to counterfeit the device), the device may, in simpler variants, simply comprise a cover 16 masking the sensing portions 40-42 in the flow path.

The concept proposed in FIG. 4 is relatively simple: individually addressed electrodes are compatible with a single, possibly complex flow path, or multiple flow paths. Note, a flow path may actually be formed (at least partly) by a liquid loading area (i.e., open to air) of the microfluidic device, where liquid can be deposited. This concept makes it possible to measure changes in the signal (e.g., capacitance) before and after an assay, for example. Any electrode could serve as a reference electrode for the measurements. For example, a given electrode 40 (say the first electrode 40, i.e., the top-left electrode in FIG. 4A) may serve as a reference and N−1 measurements can be made concomitantly, between the N−1 pairs involving the N−1 remaining electrodes and the first electrode, though a larger number of unique combinations can be contemplated. The corresponding signals are typically acquired as a multiplex signal. This approach does not require to measure transient changes (two sufficiently distinct values suffice to ascertain a change in the signal corresponding to one pair); it does further not necessarily require a calibration of the flow rate. I.e., information as to the flow rate is not needed, even if the liquid flow slows down along a long channel (contrary to designs involving electrode pairs and a single pair of electrical contacts, as discussed below). However, this approach has a drawback: the number of contact pads 40 scales linearly with the size of the code, which impacts the footprint of the chip. Also, a large code will make the signal routing difficult and impact the signal-to-noise ratio. In addition, a multiplexer circuit is typically required to address each electrode pair at a given time because simultaneously measuring the capacitance of several electrode pairs may not be feasible due to the limited number of input-output ports and integrated analog-to-digital converters available in typical microcontrollers.

Therefore, a second class of mapping may be preferred, wherein the sensing portions of the electrodes are arranged in pairs branching from only two electrical contacts, as assumed in FIGS. 1, 2, 5, and 9-12. More precisely, the sensing portions 41, 42 are arranged in pairs {41, 42} and each pair is connected to the same pair of electrical contacts 51, 52, whereby two sensing portions 41, 42 of each pair of electrodes are connected to respective electrical contacts 51, 52 of a single pair of electrical contacts. In addition, each material spot 61, 62 coats a respective pair of sensing portions 41, 42 (i.e., both portions 41, 42 of that pair) in the flow path, as best seen in FIG. 2B.

Figure 2D:
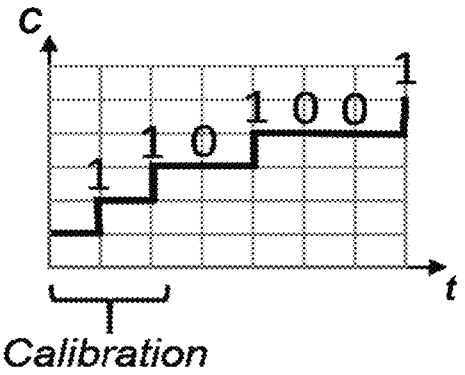
FIG. 2D shows a plot of an ideal, double-layer capacitance signal that can be measured from the pair of electrical contacts of the device, upon the liquid advancing along the flow path and contacting the electrodes. The incremental increases of the capacitance are modulated by the presence (or not) of material spots on the electrode pairs.
Figure 5A:
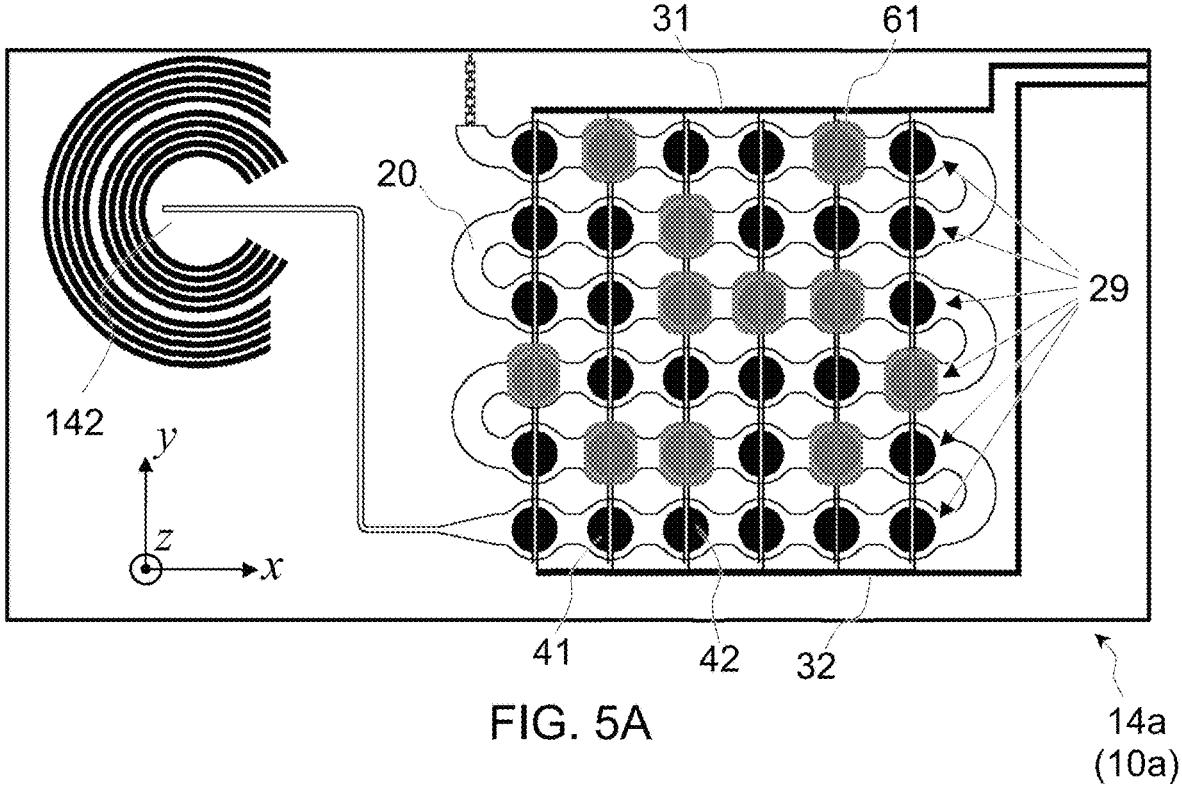
FIG. 5A is a top view of a layout conceptually similar to that of FIG. 1 or 2, wherein some of the electrode pairs are coated with insoluble material spots, as in embodiments.
Figure 5B:
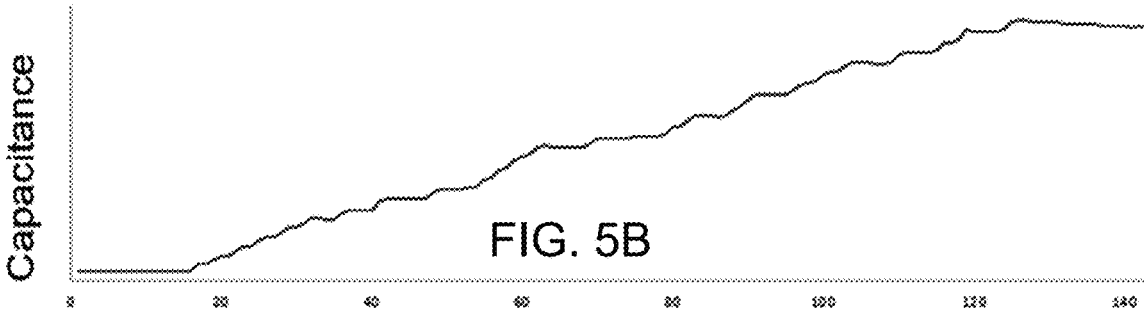
FIG. 5B shows a corresponding cumulative capacitance signal (experimental).

This makes it for instance possible to detect a double-layer capacitance signal, leading to unexpectedly clean and distinct increments in the single signal measured, as illustrated in FIG. 2D or 5B. Whether the signal stays flat or increments depends on whether a material spot is present or not, as seen by comparing FIGS. 2C and 2D.

Interestingly, measuring a single, cumulative capacitance signal allows the electrode layout to be radically simplified, even when the flow path involves several, parallel flow path sections, see for example FIG. 5A. Namely, the sensing portions 41, 42 may be decomposed into two subsets, branching from distinct branches 31, 32 of the electrode circuits, where only two common branches 31, 32 are needed, which connect to respective electrical contacts 51, 52. The concept is easily scalable. Beyond the simple example of FIG. 2, this concept is further compatible with more sophisticated designs. For example, in FIG. 5A, any two electrode sensing parts 41, 42 form a pair and the sensing parts 41, 42 of each pair connect to distinct branches 31, 32 (though not always directly). For instance, in the lower flow path section, sensing portions 42 connect directly to the lower branch 32, while the other sensing parts 41 connect indirectly to the upper branch 31, via other sensing parts 41. On the contrary, in the upper flow path section, each sensing portion 41 connect directly to the upper branch 31, while the other sensing parts 42 connect indirectly to the lower branch 32, via other sensing parts 42. Each branch 31, 32, is arranged outside the surface 20 defining the flow path and is connected to a respective electrical contact 51, 52, just like in FIG. 2. Using such a conceptual design, the electrode circuit can be entirely patterned on one side of the device, i.e., the side on which the flow path is provided. And again, pairs of electrode sensing portions 41, 42 are preferably arranged at regular intervals (at least in each parallel flow path section), to ease extraction of time-dependent information, as needed to derive a time-dependent capacitance signal.

A design involving electrode pairs 41, 42 branching from two common branches, themselves connected to two electrical contacts 51, 52, makes it possible to detect successive increases in a cumulative capacitance signal, based on which a code can be retrieved. I.e., a substantial increase over a given time interval (corresponding to the time needed for liquid L to travel from one pair 41, 42 to the next pair) may for instance be associated to a 1 (corresponding to an uncoated electrode pair), whereas a too small increase (e.g., owing to a soluble ink spot) or no increase at all (uncoated electrode pair) would be associated to a 0, for example.

Figure 3:
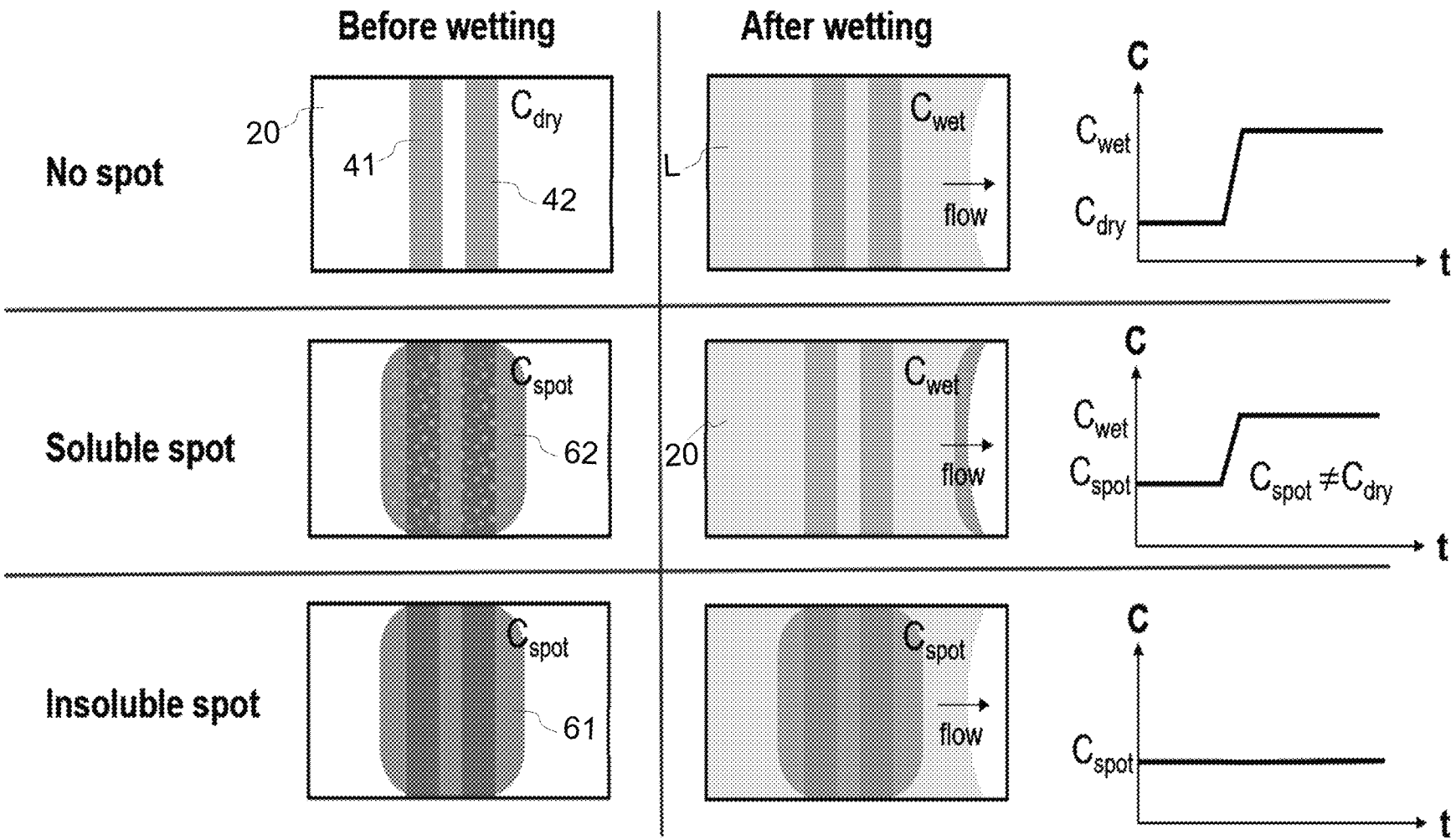
FIG. 3 illustrates the increase of a (double-layer) capacitance observed upon a liquid bridging a pair of naked electrodes (top row), electrodes coated with a soluble spot (middle row) or with an insoluble spot (bottom row), as exploited in embodiments to derive a code captured by a pattern of spots coated on electrode pairs.

This is illustrated in FIG. 3, where:

$C_{dry}$ denotes a fringing capacitance through the air and the substrate in the dry state;

$C_{spot}$ refers to a dry-state capacitance in the presence of a spot (be it soluble 62 or not 61); and $C_{wet}$ is the double-layer capacitance value as measured in the presence of a liquid.

As seen in FIG. 3, an uncoated electrode pair eventually leads to a capacitance value of $C_{wet}$, substantially larger than $C_{dry}$, whereas an electrode pair coated with a soluble spot 62 will typically lead to a capacitance value, which, although it is larger than $C_{dry}$, is smaller than $C_{wet}$. On the contrary, no substantial increase in the capacitance increase is measured between electrodes coated with an insoluble spot 61. Thus, electrode pairs lead to distinct contributions to the cumulative capacitance, depending on whether they are coated and the material of the spot they are coated with.

Figure 5C:
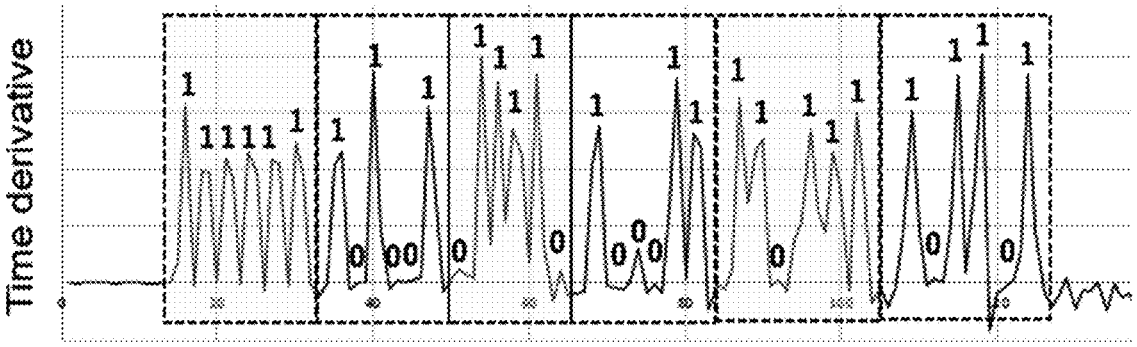
FIG. 5C illustrates how the embedded code can be retrieved from local extrema identified in the curve of FIG. 5B.

Applying this to an electrode design such as shown in FIG. 2 (where sensing parts 41, 42 are interdigitated to form pairs along a single flow path and connected to the same contacts 51, 52), one understands that incremental increases can be measured in a cumulative capacitance (see FIG. 5B) during the propagation of the liquid flow. Such incremental increases may, in turn, be interpreted as a stream of digital bits, as illustrated in FIG. 2D or 5C.

This approach leverages the second class of mapping evoked earlier; it requires only two contact pads 51, 52 and simplifies the electrode designs. However, the capacitance signal is always cumulative in this case, a limited number of unique combinations (electrode pairs) are available (e.g., for a pre-assay validation, as discussed later), and information as to the flow rate will typically be needed for long channels (e.g., longer than 10 mm for 0.2 mm wide channels). Such information may be estimated and taken into account in the code retrieval process.

Figure 10A:
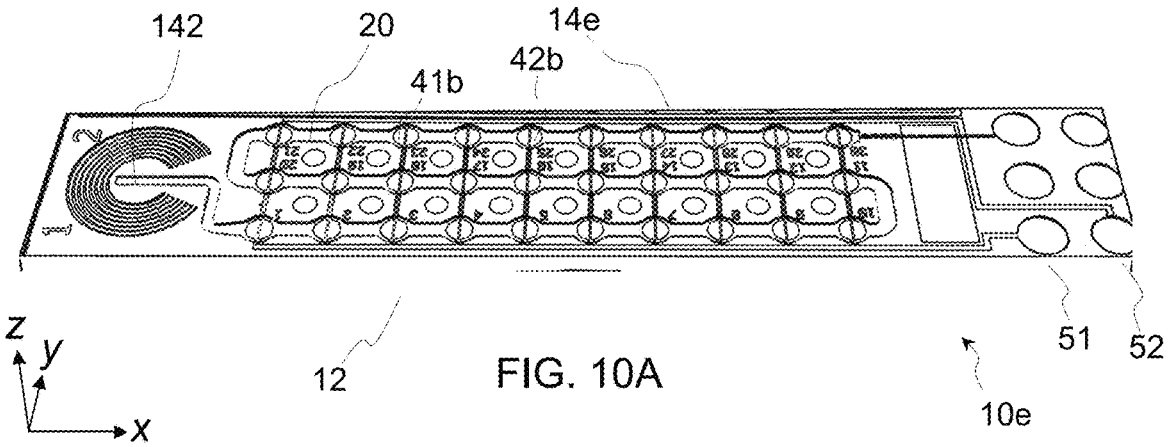
FIGS. 10A and 10B are photographs of an actual device (conceptually similar to the devices of FIGS. 1 and 5A), prior (FIG. 10A) and after (FIG. 10B) coating some of the electrodes with insoluble ink spots using a permanent marker, as in embodiments.
Figure 10B:
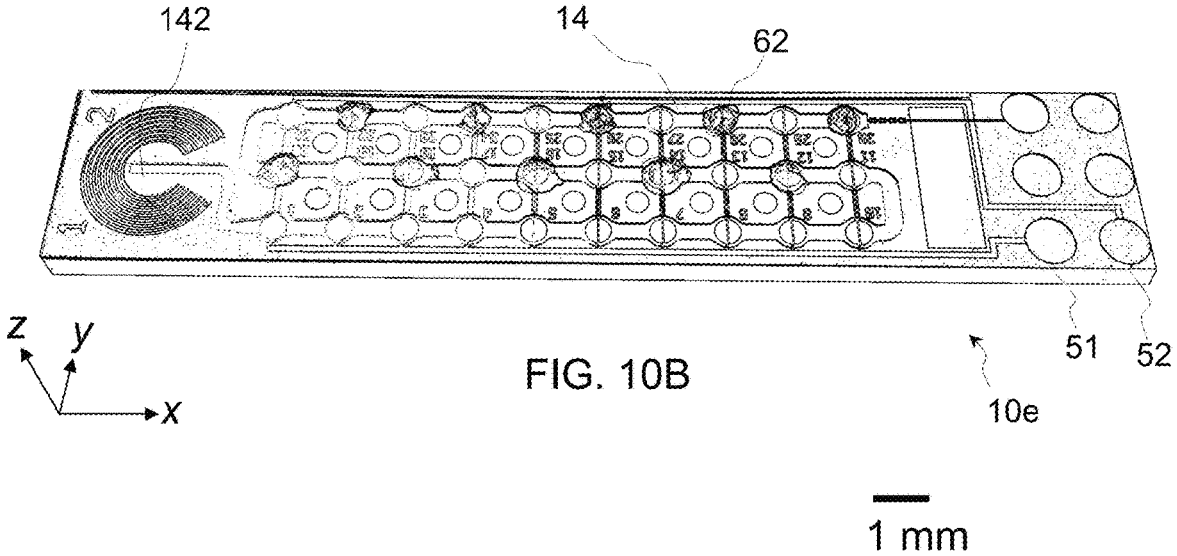

In variants, it may be accessed via upstream electrodes (similar to clock recovery in digital communication) or measured via an additional set of electrodes. Here, a few design parameters may advantageously be optimized to improve performance for the code extraction. For example, measuring the capacitance in high sensitivity typically requires a slower sampling rate. In other words, a change in the signal due to a change in the capacitance should be higher than the electronic noise and a larger capacitance (larger electrode area) is thus preferred. However, larger capacitances require longer measurement times (larger time-constant) and, thus, a slower sampling rate. If the flow velocity is faster than the sampling rate of the measurement, some "bits" may not be extracted, leading to an erroneous code. According to the experiments performed by the inventors, a sampling rate of 1 to 10 measurement per second is preferred for flow velocities ranging from 0.1 to 1 mm/s. For electrode pairs such as shown in FIGS. 1, 5A, and 10A, the change in the capacitance per "bit" (i.e., one wetted electrode pair) is typically 100 pF to 500 pF for common liquids, such as de-ionized (DI) water, drinking water, biological buffers, NaCl solutions, where the electronic noise of the peripheral readout device is less than 10 pF. However, like the flow rate, the electronic sampling rate is not critical for a design with individually addressable electrode such as shown in FIG. 4A.

The liquid flow rate may for instance be calibrated based on signals measured with the most upstream electrode pairs 41, 42, which must therefore be free of any material spots, as assumed in FIGS. 2, 5, 10 and 11. In such embodiments, the pairs of sensing portions 41, 42 form an arrangement of successive pairs along the flow path. Now, upstream pairs of this arrangement (the closest pairs to the liquid inlet 142, 162 in terms of liquid propagation along the flow path) are not coated by any material spot. For example, the first two pairs may be kept free of any spot, as assumed in FIG. 2. This, as one realizes, is sufficient to extract both a flow rate and liquid conductivity information, which in turn allows the capacitance signal to be calibrated. Alternatively, both the liquid conductivity and flow rates may be known in advance or estimated, such that a single, uncoated electrode pairs 41, 42 may be sufficient to infer a timing for the signal. In other variants, the capacitance measurements could be triggered by the user, e.g., upon insertion of a microfluidic chip in a peripheral device, while the time necessary for the liquid to reach the successive electrode pairs could be predetermined. Still, the first electrode pair 41, 42 is preferably uncoated, so as to measure a capacitance jump, indicating the beginning of a sequence. In the example of FIG. 2D, calibration steps based on the first two electrode pairs allow to infer a timing, according to which successive incremental increases in the capacitance are logged, which are can then be assigned to binary values (no jump: "0", jump: "1"). Several methods can be used to interpret the capacitance increases over time, for example based on local extrema (FIGS. 5A-5C).

Figure 11A:
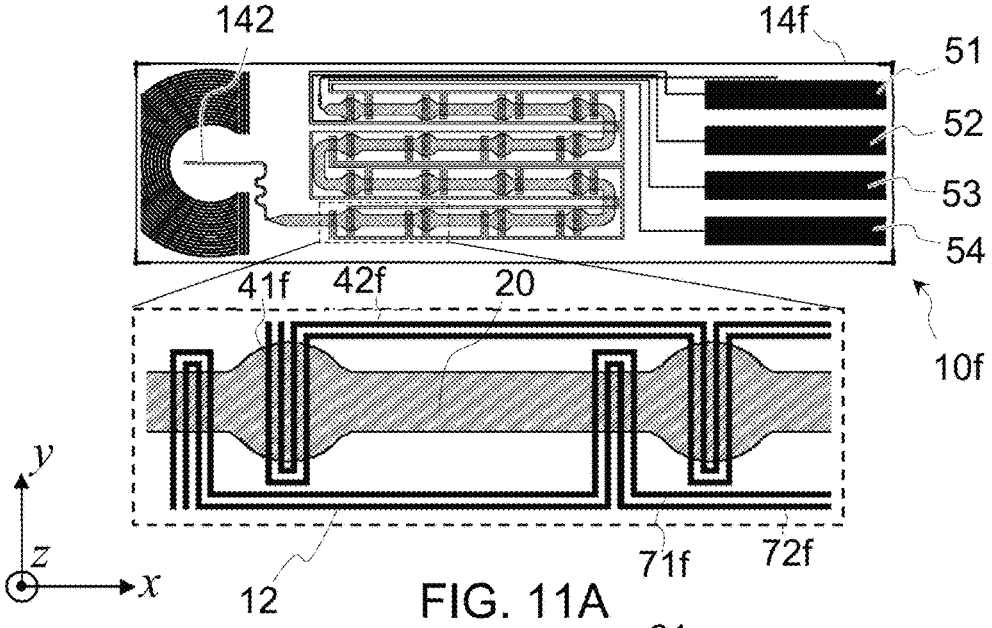
FIGS. 11A and 11B are top views of a device whose layout is conceptually similar to that of FIG. 1, 5A or 10, except that it now includes a second set of contacts and electrodes designed so as to detect the progression of the liquid, as in embodiments, to ease the derivation of the code, e.g., from a time-dependent capacitance signal, as illustrated in FIG. 11C.
Figure 11B:
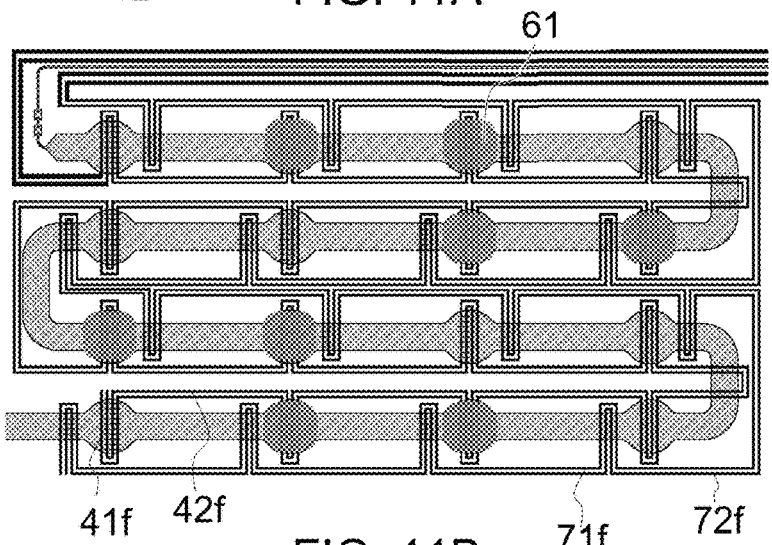
Figure 11C:
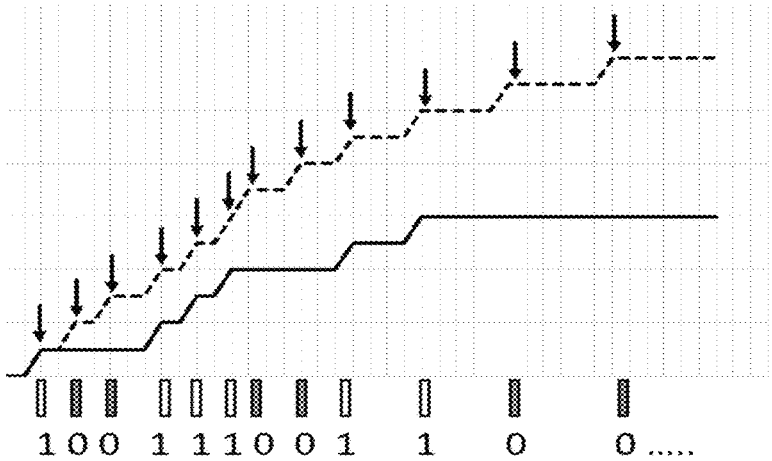
FIG. 11C presents a dashed curve showing incremental increases in the capacitance signal obtained from the second set of electrodes, and a plain curve showing the increases obtained with the first set of electrodes, as modulated due to the material spots. The timing information contained in the dashed curve is used to interpret the plain curve even if the flow rate is not constant along the flow path.

Calibrating the signal based on upstream electrodes is fairly simple. However, an accurate calibration "consumes" electrode pairs, at the expense of the code. Therefore, additional sets of electrodes and contacts may possibly be relied on, as now described in reference to FIGS. 11A, and 11B. Here the microfluidic device 10*f* further comprises second sets of electrical contacts 53, 54 and electrodes 71*f*, 72*f*, in addition to the first sets of electrical contacts 51, 52 and electrodes 41, 42. In the layout of FIGS. 11A, 11B, the additional electrodes 71*f*, 72*f* are connected to additional contacts 53, 54 and are further arranged so as not to interfere, electrically, with the first electrodes 41, 42 on the microfluidic device. I.e., each electrode circuit need be complementarily designed on the chip, without contacting each other. One way to achieve this is for the electrodes 71*f*, 72*f* to include bent portions 71*f*, 72*f*, which extend across the flow path, transversally to the propagation direction of the liquid, while larger (non-bent) portions may extend along the flow path but outside the latter. Note, the first circuit too may similarly include bent portions, interdigitated with the bent portions of the second circuit 71*f*, 72*f*, to make up a compact arrangement, as seen in FIG. 11B. In all cases, the bent portions of the second circuit 71*f*, 72*f* are preferably positioned upstream the corresponding sensing portions 41*f*, 42*f* of the first circuit, so as to most simply detect timings of the liquid as it reaches the pairs of sensing portions 41*f*, 42*f*.

In other words, a second set of uncoated electrode pairs (timing electrodes), connected to different electrical contacts, can be placed "before" the sensing electrodes 41*f*, 42*f* to extract the liquid position and timing information regardless of the possible variations of flow rate along the flow path. I.e., the liquid first wets a timing electrode pair, the system then expects a 1 or 0 from the code electrode pair patterned right after the timing electrode pair, and so on. As for instance illustrated in FIG. 11C, that a jump in the dashed curve (timing electrode pairs) correlates with a jump in the plain curve (capacitance sensing electrode pairs) means that the sensing pair is not bypassed (uncoated), which is associated with a "1". On the contrary, if the plain curve remains flat where a jump in the dashed curve is observed, then this means that the sensing pair is bypassed (e.g., coated with an insoluble spot), which is associated with a "0", and so on. The timing electrodes 71*f*, 72*f* give rise to measurements that are electrically independent from the code measurements, to avoid any electrical cross-talk.

In reality, the jumps in the two curves will not be perfectly synchronous, owing to the slight time interval corresponding to the distance between a timing electrode pair and a sensing electrode pair. Also, in variants, the bent portions of the second circuit 71*f*, 72*f* can be positioned downstream the sensing portions 41*f*, 42*f* of the first circuit, provided that the corresponding space shift is corrected, time-wise, when interpreting the cumulative capacitance signal.

In other variants, the flow path may itself be modified, to cope with issues related to the alteration of the flow rate due to the length of the flow path. For example, referring to FIGS. 12A and 12B, the microfluidic device 10*g* may again include several (e.g., parallel) flow path sections 29, as in FIG. 5A. However, each section 29 further comprises, in addition to a main channel 21, a trigger channel 24, to which the main channel 21 leads. Each section 29 additionally includes a set of areas 22, across which extends a sensing pair of electrodes 41*g*, 42*g* (e.g., realized as bent portions). That is, the sensing portions of electrodes 41*g*, 42*g* are now arranged in dedicated areas 22, each branching from the main channel 21. Moreover, each section 29 now includes a bypass channel 25, which branches from the main channel 21 upstream the corresponding areas 22 (with respect to the liquid inlet 142). The bypass channel 25 leads to a junction 26 between the trigger channel 24 of the section 29 and the main channel 21 of a next section 29*a*. The "next" section 29*a* is a flow path section arranged downstream a section 29 (with respect to the liquid inlet 142). The junction 26 forms a trigger valve designed such that liquid at the junction 26 can fill the next main channel 21 only if the trigger channel 24 adjoining that junction 26 is already filled with liquid.

That is, each (row) flow path section 29 is segmented and triggered with valves 26, forcing the liquid flowing from the liquid inlet 142 to the respective channels without substantially increasing the overall flow resistance (i.e., each flow path section 29 requires substantially the same amount of time to be filled with the liquid). This makes it possible to stem the liquid flow and thus improve control on the liquid progression. Else, the flow rate may decrease while the liquid advances in a long channel, which could complicate the decoding. As further shown in FIG. 12, one-way valves 22*v* placed at the entrance of the small chambers (areas 22) with electrodes can be used to create codes as an alternative to using soluble or insoluble inks. Here, an aqueous solution of a surfactant (e.g., 0.05% Tween 20 surfactant in PBS buffer) can be precisely inkjet-spotted on top of the valves to deactivate them. In other words, a liquid advancing in the main channel 21 cannot enter the chamber with the electrode pair (code "0") unless the respective valve is deactivated with a surfactant (code "1"). Inkjet-spotted surfactant is invisible after it dries, thus, the code is inherently concealed. Each chamber 22 preferably communicates with a respective trigger channel 24 via a two-way valve 23, to allow the air compressed as liquid fills the chambers 22 to be vented via the channels 24, while preventing the liquid to flow from the channel 24 to the chamber 22 and vice versa. Note, in variants, the junction 26 could be formed right at an upstream area 22 of each section 29, contrary to the depiction of FIG. 12.

Figure 6:
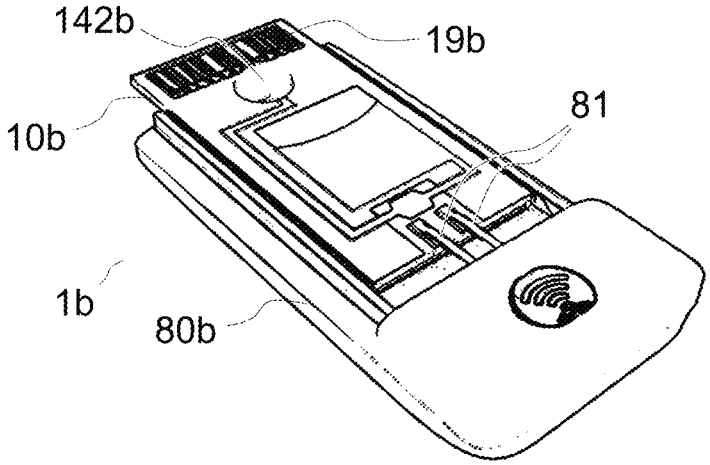
FIG. 6 is a 3D view of a microfluidic chip inserted in wireless readout peripheral for reading a signal from electrical contacts of the chip, as in embodiments. Signals read via the peripheral (prior and after introducing a liquid in the chip) are transmitted to the smartphone, for security and/or validation purposes, as otherwise illustrated in FIGS. 8A-8C.
Figure 7:
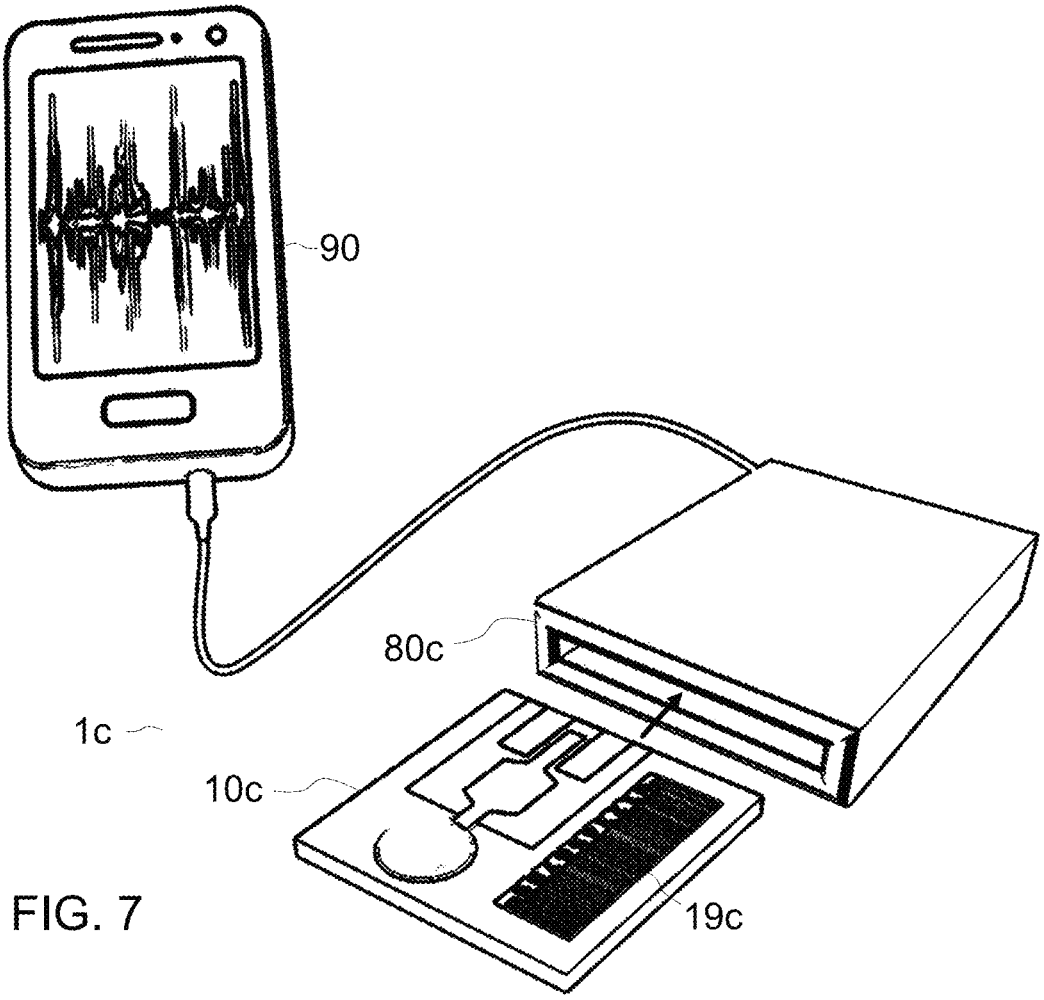
FIG. 7 is a 3D representation of a microfluidic chip insertable in a readout peripheral, which is wired to a smartphone for recording a signal obtained from electrical contacts of the chip, as in embodiments.

Additional aspects of the present microfluidic devices and system are now described in reference to FIGS. 6-8, which illustrate how the devices can be used in practice. For example, the microfluidic device may be primarily implemented as a chip 10*b*-*d*, accompanied by one or more peripheral units 80*b*, 80*c*, 90. The chip is connectable to (e.g., insertable in) a peripheral unit, for the latter to connect to electrical contacts 51-54 (e.g., via suitable connectors, such as lugs 81 in FIG. 6) of the microfluidic chip. The peripheral units may generally be configured to detect the desired signal and derive said code. Such units may for instance include a dedicated peripheral unit 80*b* or interface 80*c* for performing the signal readout, as assumed in FIGS. 6-8. In embodiments, a single peripheral unit (not shown) can be used to both read the signal, derive the code and possibly verify/validate the latter (e.g., by comparing it to some reference data). In preferred variants, however, a first peripheral 80*b*, 80*d* (e.g., a compact and low-cost peripheral) is used to measure a capacitance signal from the electrical contacts of the chip 10*b* and send corresponding data to a second peripheral (e.g., a neighboring smartphone 90, using any suitable wireless connection), as assumed in FIGS. 6, 8. In other variants (FIG. 7), the readout is performed using internal electronics and applications or services (e.g., audio of a smartphone 90), by connecting an interface 80*c* to the smartphone 90, e.g., via an audio cable, as assumed in FIG. 7. In other variants, a low-cost peripheral 80*c* can be connected to the phone 90 using a USB On-The-Go (OTG) cable, which supplies 5V to the peripheral and establishes a two-way communication with the peripheral 80*c*. The peripheral 80*c* may also perform capacitance measurements from multiple electrode pairs connected to different electrical contacts, e.g., a set of electrode pairs for the sensing of the code, and an additional set of electrodes for the extraction of the timing information, as explained earlier. Such a multiplexed measurement can for instance be achieved by using an internal multiplexer of a multiprocessor or an external analog multiplexer. The timing electrode pairs can for example be selected and measured for 100 ms, then the code sensing electrodes can be selected and measured for the next 100 ms, and so on.

Figure 13:
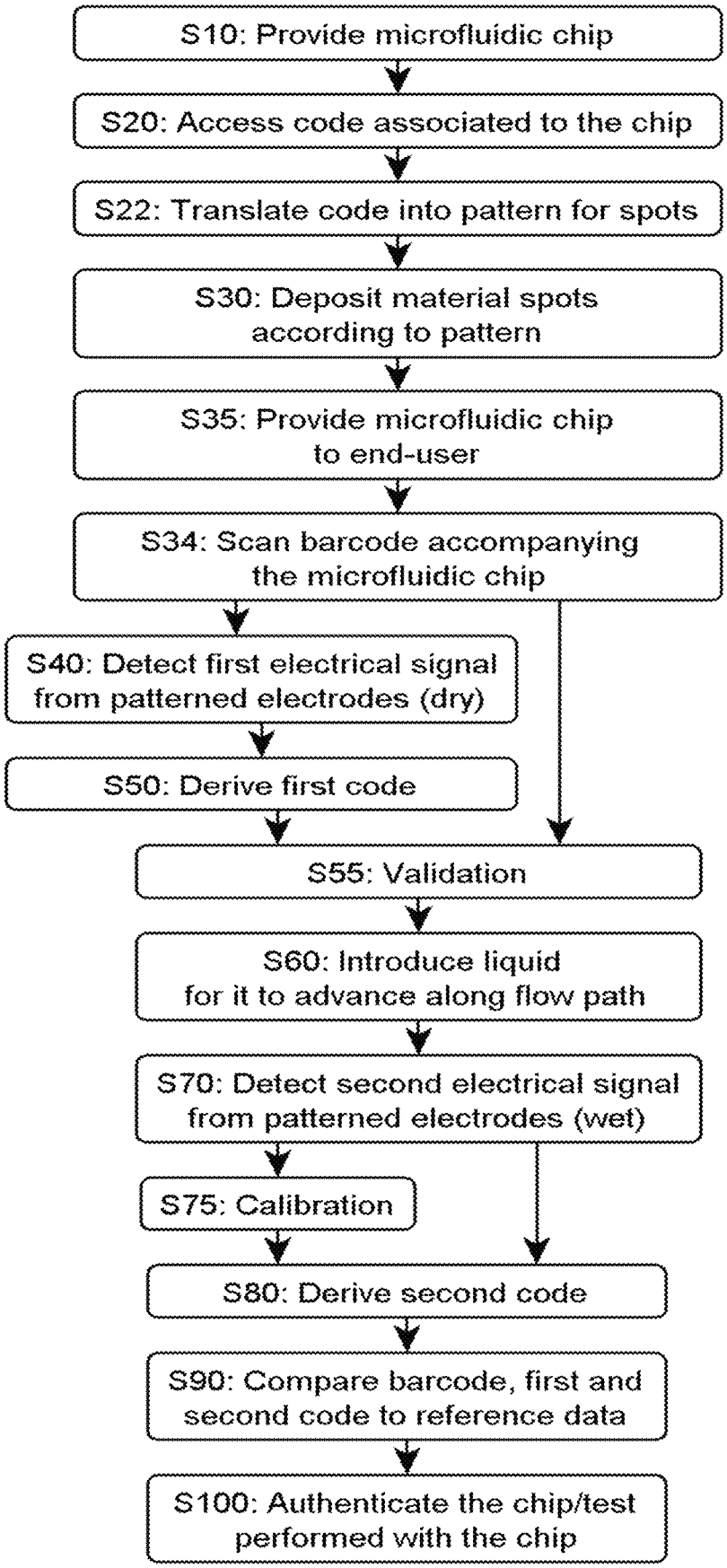
FIG. 13 is a flowchart illustrating high-level steps of method of conditioning and operating a microfluidic device, as in embodiments.

Referring now more specifically to FIG. 13, another aspect of the invention is now described, which concerns a method of operating a microfluidic device, such as described above. Aspects of this method have already been implicitly addressed earlier are only briefly explained in the following.

Essentially, this method relies on a microfluidic device 10, 10*a*-10*g* as described earlier. I.e., this device includes a surface 20 (defining a flow path for a liquid L), a set of electrical contacts 50-52 and a set of electrodes 31, 32, 40-42 (including sensing portions 40-42 suitably extending across the flow path), connected to the electrical contacts 50-52. As already discussed, material spots 61, 62 are formed on at least some of the sensing portions 40-42. Yet, spots 61, 62 of a same material only coat a subset of the sensing portions 40-42, so as to capture a code.

The method generally requires introducing (step S60 in FIG. 13) a liquid L in the device for the liquid to advance along the flow path. Then, an electrical signal is detected (step S70) from the electrical contacts 50-52, as the liquid L advances along the flow path and contacts the electrode sensing portions. As explained earlier, the signal detected S70 happens to be altered over time by the liquid L and the alterations of the signal are further modulated by the presence or absence of the spots 61, 62. Finally, a code is derived S80 from the (altered) electrical signal detected. Note, the flow path may notably include reagents, as necessary to perform a microfluidic test or assay, although reagents could be integrated in another flow path (not shown), e.g., branching from the inlet or the flow path 20. The outcome of the test/assay may possibly be checked via additional electrodes, or using optical detection means or other sensing means.

The code derived at step S80 can then be exploited to validate the test/assay and/or verify that the device is not counterfeited, for example. This will typically require instructing computerized means (e.g., via or at a connected smartphone) to automatically compare S90 data corresponding to the code derived with some reference data, which can be internally available (e.g., in a dedicated application of the smartphone) or downloaded on-demand, for example. The reference data may further include or correspond to data encoded in a barcode 19*b*, 19*c* or a QR-code 19*d* on the chip or its packaging, for example, which data can be acquired S34 beforehand, e.g., optically scanned with a smartphone (FIG. 8A) prior to perform the test/assay. The optical code can be linked to the electronic code via a security key so that the authenticity of the device can be verified even without connecting to a cloud database when no internet connection is available (i.e., offline authentication).

Figure 8A:
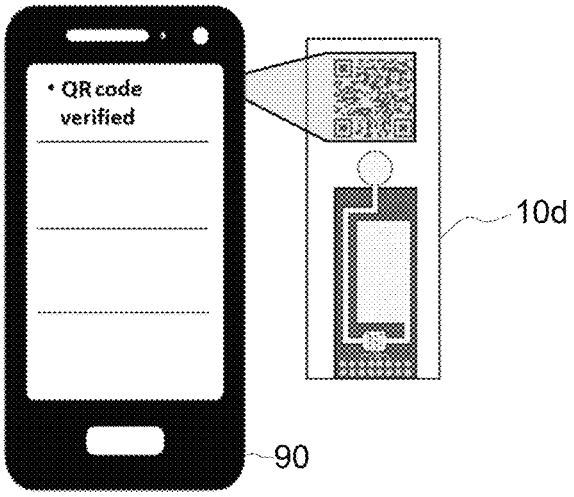
FIGS. 8A, 8B, and 8C show signals transmitted to the smartphone, for security and/or validation purposes.
Figure 8B:
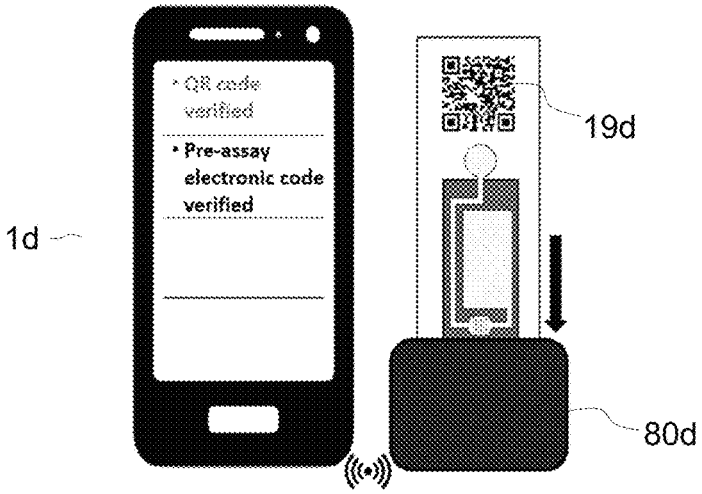
Figure 8C:
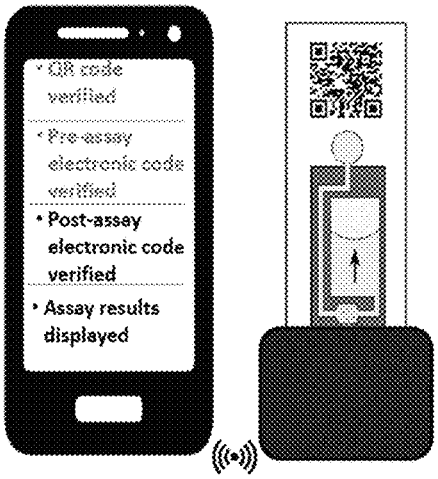
Figure 9A:
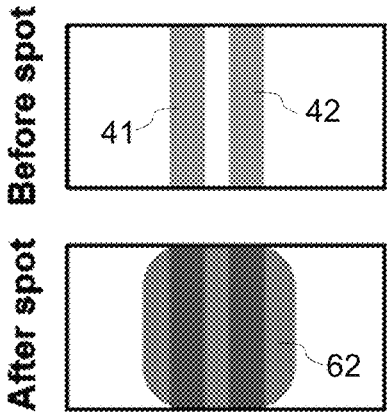
FIGS. 9A-9F are top views illustrating various possible shapes for the sensing portions of the electrodes, as involved in embodiments.
Figure 9B:
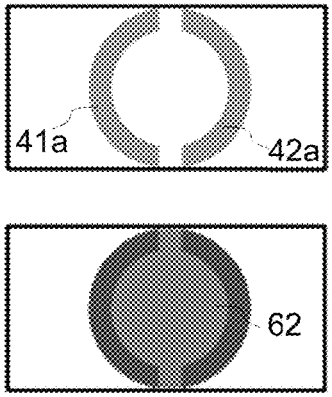
Figure 9C:
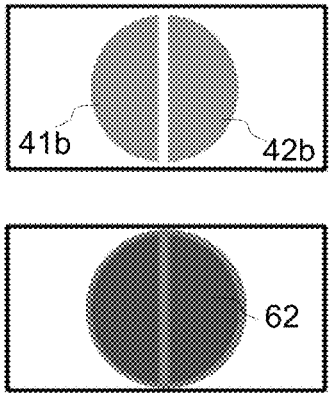
Figure 9D:
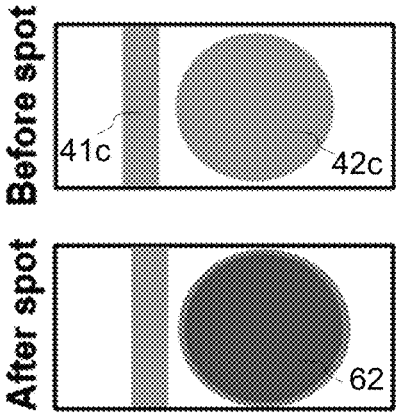
Figure 9E:
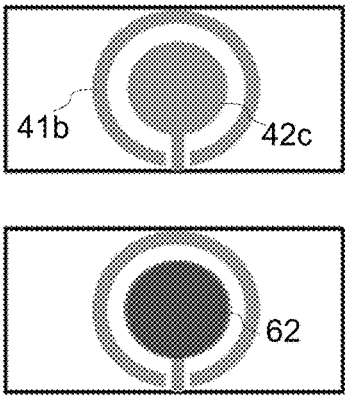
Figure 9F:
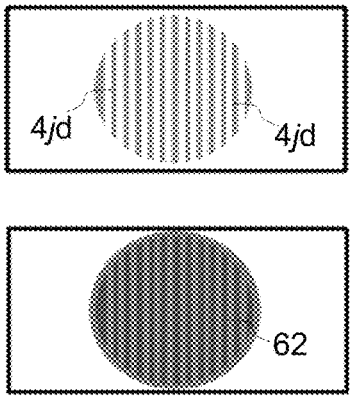

In embodiments, a "dry" readout may be initially performed, as further assumed in the application example of FIGS. 8A-8C. In that case, the method further comprises, prior to introducing S60 the liquid L, detecting S40 a first electrical signal from the electrical contacts 50-52 and deriving S50 a first code from the first electrical signal detected. The initial readout performed S40-S50 may give rise to a first verification, step S55, e.g., based on a comparison of the first code derived with some reference data, as assumed in FIG. 8B.

Then, liquid is introduced S60 and, after having derived S80 the second code from the second ("wet") signal detected, the second code derived at step S80 may possibly be compared S90 with the first code and/or reference data. In embodiments, bi-partite comparisons are performed at steps S55 and S90, whereby each of the first and second codes derived is compared to respective reference data. In variants, tri-partite comparisons are performed, whereby the outcome of step S90 should be consistent with the outcome of step S55, which itself should be consistent with some reference data. Other verification scenarios can be contemplated.

Similarly, various practical implementations can be envisaged. For example, as illustrated in FIGS. 8A-8C, a smartphone 90 may be used to communicate with a readout peripheral 80*c*, e.g., using any suitable wireless or wired data communication protocol. A dedicated application of the smartphone may be started, which automatically initiates the connection with the peripheral 80*c* and prompts the user to scan S34 a QR-code 19*d* accompanying the device 10*g* (FIG. 8A). Note, although the chip 10*g* may already be inserted (partly) in the peripheral 80*d* at this stage, the QR-code may nevertheless be suitably arranged on an external portion of the chip 10*g*, as illustrated in FIG. 8B. A first readout is then performed S40, prior to performing the assay or test, to derive S50 a first code and possibly validate S55 the code by comparison with the QR-code scanned S34. Note, the first readout may also be exploited to subsequently calibrate the wet signal detected at step S70. After introducing S60 the liquid L in the device (e.g., via a dedicated liquid inlet on the chip), a second readout is performed S70, leading S80 to a second code, which can be compared S90 to the first code, the QR-code and/or any other reference data (e.g., remote data stored on a server), for verification/validation purposes S100 (FIG. 8C). In preferred embodiments, the readout peripheral continuously sends S70 the raw (cumulative) capacitance data, then the code is extracted S80 from changes identified in the cumulative capacitance, by processing the raw data by the smartphone or data processing in the Cloud, for example.

The signal detection and code derivation are now discussed in detail. The signal detected at step S70 may for example be converted into a time-dependent capacitance, e.g., based on timings acquired independently from the measurement of step S70. As noted earlier, the capacitance measured may essentially reflect a double-layer capacitance signal: the intrinsic and mutual capacitances will likely be very small, in comparison. In variants, a time-dependent electrical impedance could be measured. In other variants, the signal could possibly measure electrochemical changes, for example. In all cases, however, the underlying physics (capacitance, impedance, or electrochemical changes) relates to phenomena occurring between and at pairs of the sensing electrodes 40-42. While the primary detections performed at steps S40, S70 may already lead to the desired quantity (i.e., without any conversion being needed), the signal may typically need be converted in a form suitable for the subsequent operations, starting with the code derivation S50, S80.

The signal detected may notably be converted S70 into a signal corresponding to a properly timed cumulative capacitance, assuming that detection is performed thanks to an arrangement of successive electrode pairs. In that case, the derivation S80 of the "wet" signal requires to identify successive, incremental jumps in the signal. And this may notably be performed S80 by locating local extrema of the cumulative capacitance: values of the code can be derived from the extrema located. To that aim, one may for instance compute the time derivative of a quantity obtained from the detected signal. Local minima may for instance correspond to 0, while local maxima would be interpreted as 1, as already discussed earlier in reference to FIGS. 5B and 5C.

A code derivation S80 based on a cumulative capacitance signal relies on consecutive electrode pairs, as in FIGS. 2, 5, 10-12. Namely, sensing portions 41, 42 of the set of electrodes are arranged in pairs, where each pair is connected to a same pair of electrical contacts 51, 52. I.e., two sensing portions 41, 42 in each pair are connected to respective electrical contacts 51, 52 and a single pair of electrical contacts is required to that aim. As also discussed earlier, the material spots 61, 62 will coat the two sensing portions 41, 42 of a respective pair of sensing portions 41, 42, as best seen in FIG. 2. This way, the electrical signal can be detected S70 from the electrical contacts 51, 52, so as to detect incremental increases in the time-dependent capacitance signal, and the code is subsequently derived S80 from the detected incremental increases in the time-dependent capacitance.

Alternatively, the sensing portions 40 of the electrodes may be connected to respective electrical contacts 50, as in FIG. 4, in which case the spots 61, 62 coats a respective sensing portion 40. In that case, electrical signals are detected S70 from the contacts 50, so as to detect changes in respective capacitance signals. The number of parallel signals corresponds to the number of pairs of contacts 50 sensed, e.g., choosing one contact as a reference, as explained earlier. The code is finally derived S80 from the changes observed in each of the capacitance signals detected. The capacitance signals can be acquired as a multiplexed signal, for example. Substantial changes in each of the capacitance signals can be associated to the absence of insoluble spots 61, whereas insoluble spots 61 would lead to no noticeable changes in the measured signal. Again, the presences and absences of spots 61, 62 capture a code, which can be retrieved by electrical sensing.

Referring back to FIG. 2, the upstream electrode pairs may purposely be left uncoated, as in embodiments described earlier. In that case, properties (e.g., flow rate, conductivity) of the liquid L may be extracted S75 based on the signal detected via the most upstream electrode pairs, to calibrate S75 the signal, in particular the timing corresponding to incremental increases in the capacitance detected S70. The code is subsequently derived S80 based on the calibrated signal. In variants, however, the timing is derived from detections performed via an additional set of electrodes, as assumed in FIG. 11. In other cases, the variations of the flow rate of the liquid may be known in advance; they may notably be quite accurately predicted, owing to the particular design of the flow path, as in the example of FIG. 12.

Still referring to FIG. 13, a further and final aspect of the invention is now described, which concerns a method of conditioning a microfluidic device 10, 10*a*-10*g*. This method relies on a pre-fabricated microfluidic device 10, 10*a*-10*g*, which, as provided at step S10, at least includes: a surface 20 (defining the flow path for the liquid L); electrical contacts 50-52; and electrodes 31, 32, 40-42 including sensing portions 40-42 extending across the flow path, as described earlier. For this device to be used in a method as described above in reference to steps S35-S100 of FIG. 13, material spots 61, 62 need be deposited S30 on at least some of the sensing portions 40-42. Again, spots 61, 62 of a same material are only deposited on a subset of the sensing portions 40-42. This subset is selected S20, S22 according to a given code, translated in a corresponding pattern on the flow path. And this pattern will later cause, upon measuring S70 a wet signal, to modulate the electrical signal that is otherwise altered by the liquid advancing and contacting the electrodes.

As discussed, the material spots 61, 62 deposited S30 may possibly comprise, on the one hand, spots 62 that are soluble in the target liquid L and, on the other hand, spots 61 that are not soluble in this liquid L, so as to conceal the code modulations captured by the sole insoluble spots 61, for example. However, simpler embodiments rely on spots of a single material 61. The flow path may be covered by a lid, such that it may not be needed to conceal the code. Also, the upstream subset of sensing portions 40-42 may intentionally be left uncoated for calibration purposes, as discussed earlier.

The above embodiments have been succinctly described in reference to the accompanying drawings and may accommodate a number of variants. Several combinations of the above features may be contemplated. Examples are given in the next section.

2. Specific Embodiments—Technical Implementation Details

The present devices may be implemented as RTDs. Such a test device may notably be a portable, e.g., handheld device, such as for example a blood glucose meter, or a test kit for detecting one or several analytes (e.g., homocysteine, C-reactive protein, glycated hemoglobin or HBA1C, HIV salivary assay, test for cardiac markers, tests for detecting allergens or genetically modified organisms, for the detection of pesticides and pollutants, etc.), or a pregnancy test. More generally, it may be any type of RDT device (POCD or OTC device). Furthermore, a test device as understood herein may be used to perform analyses going beyond medical diagnostic, for example for detecting toxins in water, etc. There are potentially numerous applications for such test devices, as the skilled person may realize. Microfluidic devices are perceived as very promising for point-of-care testing by the present inventors because such devices can provide very fast tests, are portable, very accurate, and can be multiplexed for detecting several diseases in parallel.

The surface 20 supporting the flow path may possibly be structured, e.g., to form a channel, as noted earlier. The flow path may thus possibly be structured within a superficial thickness of one or more layer of the microfluidic device, as known per se. The flow path may else be defined by a wetting surface 20 adjoining a surrounding (non-wetting) surface, in-plane. Yet, the surface 20 may not be level with the surrounding surface as it is typically deposited, structured, and/or otherwise processed to be wetting (respectively non-wetting). Conversely, the surrounding surface may be processed so as to make it non-wetting (respectively wetting).

The surface 20 on which the flow path is formed is the surface of a material that shall typically be a polymer (e.g., a SU-8 polymer), silicon dioxide, glass, an epoxy substrate (as used in printed circuit boards), and a cellulose-based material (paperboard, paper, etc.). Other materials may be contemplated, such as, e.g., a metal coating. However, a metal coating may require a more complex fabrication method to prevent electrical short-circuits to the electrodes.

In the present context, microchannels (also referred to as "channels" herein) are preferably formed as a groove on a main surface of a layer 14 of the device. This layer is for example a substrate, or any layer that is sufficiently thick to provide mechanical stability to the device, although mechanical stability may be provided by means of an additional, underlying layer 12, as noted earlier. In all cases, the layer on which microstructures are patterned may typically be an essentially planar object, such as a chip, a wafer or any such planar support. This layer may include various structures formed thereon, in particular microstructures and other microfluidic features, such as capillary pumps, loading pads, anti-wetting structures (e.g., delimiting a liquid inlet), flow resistors, vents, as well as electric circuits and contact pads. The flow path structure is typically covered (sealed) by a layer or lid, which may locally be light-permissive, for detection/monitoring purposes, although the section of the flow path that contains the pattern of spots 61, 62 is preferably opaque.

Preferably, a characteristic depth of the present channels, liquid chambers, vents and other structures is in the micrometer-length range, i.e., between 1 μm and 200 μm (and more preferably between 20 μm and 200 μm). Yet, some particular structures of the present devices may be in the nanoscale range or in the millimeter range, the devices as a whole typically being in the centimeter range. Widths (e.g., as measured in-plane) for the channels and vents will typically be in the micrometer-length range too.

Meanwhile, the average width of the flow paths is preferably between 50 μm and 1000 μm and, more preferably, between 100 μm and 400 μm. The diameter of the sensing areas 22 may slightly differ from the average channel width. The channel width is measured in-plane and perpendicularly to the direction of propagation of liquid in that channel.

Beyond electrodes needed to read the encoded pattern of spots, additional electrodes may be needed to detect the liquid, its timing, or electrical properties, etc., as well as to perform the microfluidic test itself, e.g., as part of a dielectrophoresis, electroosmotic circuit, electrochemical or impedimetric detection, etc. Other electrical circuit components like electrical pads or other connectors (forming the electrical contacts) may be patterned on the device (chip) or affixed therein, as appropriate.

Fabrication methods relying on anisotropic silicon etching may for instance be employed to obtain flush electrode surfaces. Namely, the surface of an electrode (extending across the flow path 20) that is exposed to the liquid can be fabricated so as to be level, or essentially level, with a surrounding surface in the flow path. In other words, electrodes preferably are arranged in a channel so as to be integrated within a superficial thickness of the surface of the channel that defines the flow path, the exposed surfaces of electrodes being essentially flush with the surrounding surface. This means that the misalignment between an exposed electrode surface and the surrounding surface is negligible with respect to the depth of the microchannel (preferably one to three orders of magnitude below or even less) or a typical thickness of a liquid therein. For instance, methods are known, which allow misalignments that are less than 20 nm, and even less than 10 nm, to be achieved, whereas the channel depth may for example be between 10 and 20 μm. This minimizes the surface topography and thus favors laminar flows, which may be advantageous to prevent incident in the liquid flow. A minimized surface topography is also advantageous to avoid pinning sites during the initial filling of a flow path by a liquid. This also reduces edge-defects on the electrodes and thus prevents spurious electric fields at the edges. In variants, the electrodes could be patterned on tapered side walls of the channel. It is normally possible to have all electrodes drawn on a same mask layout and patterned at the same time through the same fabrication steps.

In embodiments, a flow path of the device may comprise reagents, for enabling a diagnostic testing, for example. In such a case, the pattern of spots 61, 62 may be formed within that same flow path, but preferably downstream the reagents with respect to the liquid inlet 142, 162, to avoid interfering with the test. The pattern may for instance be located downstream control/signal lines for the test. The test line is typically a line or an area (e.g., rectangle) comprising surface-immobilized receptors, the function of which is to bind a specific analyte in a sample. Such receptors can be for example antibodies, cells, or oligonucleotides. Typically, in addition to being captured by a receptor, the analyte is also bound by another reagent that carries a label capable of generating a signal. Therefore, the signal measured on the test line or area reveals the presence of the analyte in the sample and the observed signal is typically proportional to the concentration of the analyte in the sample. The control line is typically a line, or area, comprising an analyte (made by synthesis or obtained by purifying it from natural sources). On this line, or area, of analyte, the reagent carrying the label for generating a signal will bind irrespective of the presence (or not) of analyte in the sample. This serves as positive control. Many tests are performed using this principle, or a similar principle, such as with immunoassays based on lateral flow devices. For example, in some tests, the test line is achieved by coating electrodes with receptors. This corresponds to electrochemical assays such as the well-known strip tests for measuring glucose in blood.

In other embodiments, the spots 61, 62 may be patterned within a flow path 20 that is distinct from the primary flow path that contains the reagents for the test. In that case, the flow path 20 may branch from the primary path or, in variants, directly from the liquid inlet. Still, not all types of tests involve reagents. For example, some tests may simply be based on the speed of propagation of a liquid, which can be monitored via electrodes 40, 41, 42 extending across the flow path. Note, some diagnostic tests may for instance use a static liquid applied to a well-defined area (e.g., a chamber, rather than a fully-closed microfluidic path). In such cases, it may be preferred to use independently-addressable electrodes, as shown in FIG. 4A.

The distinct flow paths are not necessarily formed on a same side of the device. However, they preferably are, be it to ease the fabrication process or the utilization of the device. Providing distinct flow paths lowers the risk of interference with reagents and sample and may furthermore be leveraged to improve timing control. I.e., based on the expected propagation speed of the liquid, a suitable path length can be calculated for the flow path 20. The pattern 61, 62 can thus be placed in the path 20, at such a distance from the liquid inlet that liquid sample can be expected to reach the pattern at a predetermined time after its introduction via the inlet. One may accordingly make sure that the liquid will not reach the pattern until a typical time for the test to complete has elapsed.

Figure 12A:
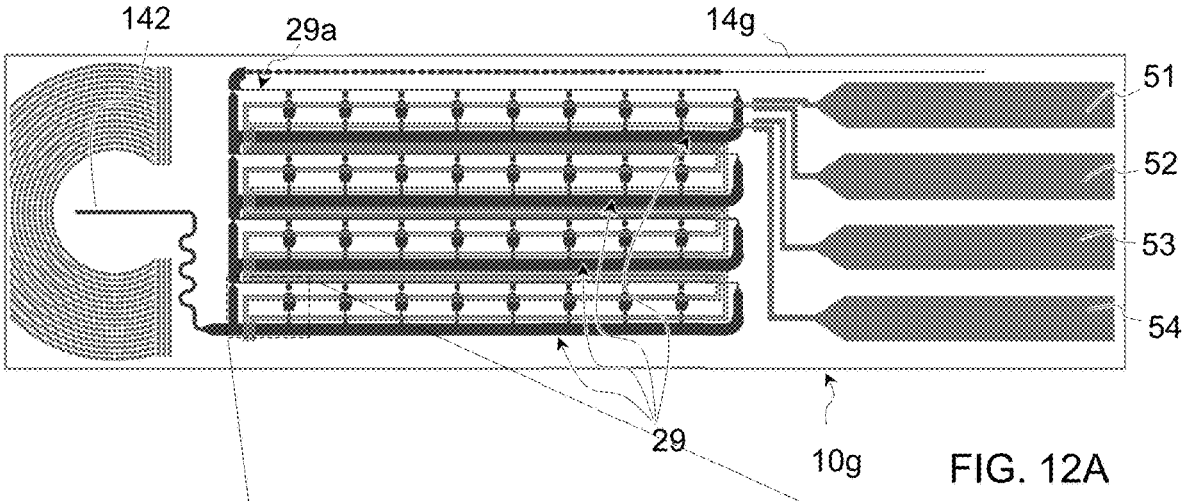
FIGS. 12A and 12B are top views of the layout of a microfluidic device involving bypassed flow path sections to stem the liquid flow and thereby improve control of the liquid progression in long channels, as in embodiments.
Figure 12B:
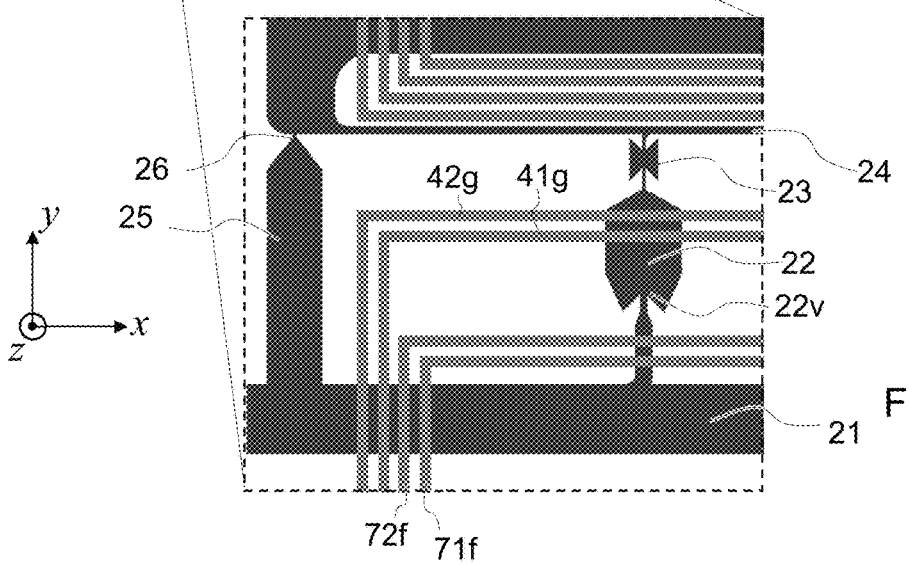

The material spots 61, 62 are typically formed by depositing or spotting liquid drops, e.g., of a colloidal solution containing particles such as colored particles, beads, quantum dots, etc. Said spots can for instance be spotted using an inkjet spotter (the spot material permitting), or using pin-spotting or quill-spotting. For example, an inkjet spotter can be used, to enable easy, accurate and fast spotting. An inkjet spotter can easily handle constantly varying patterns (in mass production). Ink and dyes may for instance be used to form the spots. The resulting spots may accordingly have more or less regular shapes, typically round or roundish. Water soluble or insoluble ink (e.g., permanent marker pen) can be used with a pen plotter to precisely deposit ink on top of the selected electrodes. Alternatively, heat transfer papers suitable for laser or inkjet printers can be used to transfer printed codes (e.g., laser toner) to electrodes. More generally, the spots may include dyes, pigments, liquid metals or alloys, colloids, proteins, beads, colored polymers, gels, oligonucleotides, surfactants (e.g., deactivating valves such as shown in FIG. 12B) or compositions thereof.

While the present invention has been described with reference to a limited number of embodiments, variants and the accompanying drawings, it will be understood by those skilled in the art that various changes may be made and equivalents may be substituted without departing from the scope of the present invention. In particular, a feature (device-like or method-like) recited in a given embodiment, variant or shown in a drawing may be combined with or replace another feature in another embodiment, variant or drawing, without departing from the scope of the present invention. Various combinations of the features described in respect of any of the above embodiments or variants may accordingly be contemplated, that remain within the scope of the appended claims. In addition, many minor modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims. In addition, many other variants than explicitly touched above can be contemplated.

What is claimed is:

1. A microfluidic device comprising:

a surface, which defines a flow path for a liquid;

a liquid inlet, in fluid communication with said surface, so as for a liquid introduced via the liquid inlet to be able to advance along a propagation direction on the flow path, wherein the flow path has a folded shape that comprises a plurality of adjacent parallel sections connected by bent portions, wherein in a first section of the flow path the propagation direction is a first direction and in a next section of the flow path the propagation direction is a next direction opposite the first direction;

a first electrical contact;

a second electrical contact;

a set of first electrodes including a set of first sensing portions extending across the flow path and transversally to said propagation direction, the first electrodes commonly connected to the first electrical contact, wherein at least one of the set of first electrodes comprises two or more sensing portions overlaying two or more of the plurality of adjacent parallel sections of the flow path;

a set of second electrodes including a set of second sensing portions extending across the flow path and transversally to said propagation direction, the second electrodes commonly connected to the second electrical contact, wherein at least one of the set of second electrodes comprises two or more sensing portions overlaying two or more of the plurality of adjacent parallel sections of the flow path; and material spots on at least some of the first and second sensing portions, wherein material spots of a same material are only on a subset of the first and second sensing portions, so as to alter an electrical signal detected from the first and second electrical contacts, in response to a liquid advancing along the flow path, in operation.

2. The microfluidic device according to claim 1, wherein subsets of one or more of the first and second sensing portions are arranged at regular intervals along the flow path.

3. The microfluidic device according to claim 1, wherein the first and second sensing portions of the set of electrodes are arranged in pairs, each pair including a first sensing portion and a second sensing portion, and each of the material spots coats the two sensing portions of a respective one of the pairs.

4. The microfluidic device according to claim 3, wherein said pairs of sensing portions form an arrangement of successive pairs along the flow path and an upstream subset of one or more of the pairs of this arrangement are not coated by any material spot.

5. The microfluidic device according to claim 3, wherein the device further comprises:

a third electrical contact; and a set of third electrodes, wherein such electrodes are connected to the third electrical contact, are arranged so as not to interfere, electrically, with the first and second electrodes on the microfluidic device, and comprise bent portions extending across the flow path and transversally to said propagation direction, upstream respective ones of said pairs of sensing portions, so as to be able to detect timings of a liquid reaching said respective ones of said pairs of sensing portions.

6. The microfluidic device according to claim 3, wherein the flow path comprises several flow path sections, each comprising:

two or more of the plurality of adjacent parallel sections each comprise:

a trigger channel;

a main channel, leading to said trigger channel;

a set of areas, across which extend the sensing portions of a respective one of the pairs, each of the areas branching from the main channel; and a bypass channel, branching from the main channel upstream any area of the set of areas with respect to the liquid inlet, the bypass channel leading to a junction between the trigger channel and the main channel of a next flow path section, the latter arranged downstream said each of the flow path section with respect to the liquid inlet, the junction forming a trigger valve designed such that liquid at the junction can fill the main channel of the next flow path section only if the adjoining trigger channel is already filled with liquid.

7. The microfluidic device according to claim 1, wherein the device comprises a layer of material processed so as to define, at least partly, a microchannel, and said surface is a bottom wall of the microchannel.

8. The microfluidic device according to claim 1, wherein said material spots of the same material comprise spots that are insoluble in a given liquid.

9. The microfluidic device according to claim 8, wherein said material spots comprise a first plurality of spots that are soluble in a given liquid and a second plurality of spots that are not soluble in said given liquid.

10. The microfluidic device according to claim 1, wherein said sets of first and second sensing portions extend, each, over an entire width of the surface defining said flow path, said width measured parallel to the surface and perpendicular to the propagation direction of the liquid at the level of said sensing portions.

11. The microfluidic device according to claim 10, wherein said at least some of the first and second sensing portions are, each, entirely coated by respective material spots thereon.

12. The microfluidic device according to claim 1, wherein the device further includes one or more peripheral units connected to the first and second electrical contacts and configured to detect said signal and derive said code.

13. A method of operating a microfluidic device, the method comprising:

providing a microfluidic device, the device including:

a liquid inlet, in fluid communication with a surface, so as for a liquid introduced via the liquid inlet to be able to advance along a propagation direction on a flow path, wherein the flow path has a folded shape that comprises a plurality of adjacent parallel sections connected by bent portions, wherein in a first section of the flow path the propagation direction is a first direction and in a next section of the flow path the propagation direction is a next direction opposite the first direction;

a first electrical contact;

a second electrical contact;

a set of first electrodes including a set of first sensing portions extending across the flow path and transversally to said propagation direction, the first electrodes commonly connected to the first electrical contact, wherein at least one of the set of first electrodes comprises two or more sensing portions overlaying two or more of the plurality of adjacent parallel sections of the flow path;

a set of second electrodes including a set of second sensing portions extending across the flow path and transversally to said propagation direction, the second electrodes commonly connected to the second electrical contact, wherein at least one of the set of second electrodes comprises two or more sensing portions overlaying two or more of the plurality of adjacent parallel sections of the flow path; and material spots on at least some of the first and second sensing portions, wherein material spots of a same material are only on a subset of the first and second sensing portions, introducing a liquid in the device for the liquid to advance along the flow path, detecting an electrical signal from the first and second electrical contacts, the signal altered over time by the liquid advancing along the flow path, and deriving a code from the altered electrical signal detected.

14. The method according to claim 13, wherein the method further comprises:

instructing computerized means to automatically compare reference data with data corresponding to the code.

15. The method according to claim 13, wherein said electrical signal is a second electrical signal, and said code is a second code, and wherein the method further comprises:

prior to introducing the liquid, detecting a first electrical signal from the first and second electrical contacts and deriving a first code from the first electrical signal; and after having derived the second code from the second electrical signal, instructing computerized means to automatically compare data corresponding to the first code with the second code.

16. The method according to claim 13, wherein the method further comprises converting the signal into a time-dependent capacitance.

17. The method according to claim 16, further comprising converting the signal into a cumulative capacitance, wherein deriving the code includes:

locating local extrema of the cumulative capacitance; and deriving different values of the code from the extrema located.

18. The method according to claim 16, further comprising:

connecting sensing portions of the first and second electrodes to respective ones of the first and second electrical contacts;

applying each of the material spots to a respective one of the first and second sensing portions;

detecting the electrical signal from said respective ones of said first and second electrical contacts, so as to detect changes in respective, time-dependent capacitance signals, and deriving the code from the changes in the time-dependent capacitance.

19. The method according to claim 16, wherein the first and second electrodes are arranged in pairs, and each of the material spots coats the two sensing portions of a respective one of the pairs of electrodes, the method further comprising:

detecting the electrical signal from the first and second electrical contacts, so as to detect incremental increases in a time-dependent capacitance, and deriving the code from the detected incremental increases in the time-dependent capacitance.

20. The method according to claim 19, wherein the pairs of electrodes form an arrangement of successive pairs along the flow path and an upstream subset of one or more of the pairs of this arrangement have sensing portions that are not coated by any material spot, and the method further comprises, while detecting said electrical signal, calibrating the incremental increases in the time-dependent capacitance by extracting properties of the liquid advancing on the flow path based on the signal detected via said subset of one or more of the pairs; and deriving the code based on the calibrated incremental increases.

21. A method of conditioning a microfluidic device, wherein the method comprises providing a microfluidic device, the device including:

a liquid inlet, in fluid communication with a surface, so as for a liquid introduced via the liquid inlet to be able to advance along a propagation direction on a flow path, wherein the flow path has a folded shape that comprises a plurality of adjacent parallel sections connected by bent portions, wherein in a first section of the flow path the propagation direction is a first direction and in a next section of the flow path the propagation direction is a next direction opposite the first direction;

a first electrical contact;

a second electrical contact;

a set of first electrodes including a set of first sensing portions extending across the flow path and transversally to said propagation direction, the first electrodes commonly connected to the first electrical contact, wherein at least one of the set of first electrodes comprises two or more sensing portions overlaying two or more of the plurality of adjacent parallel sections of the flow path;

a set of second electrodes including a set of second sensing portions extending across the flow path and transversally to said propagation direction, the second electrodes commonly connected to the second electrical contact, wherein at least one of the set of second electrodes comprises two or more sensing portions overlaying two or more of the plurality of adjacent parallel sections of the flow path, and depositing material spots on at least some of the first and second sensing portions, whereby material spots of a same material are only on a subset of the first and second sensing portions, the subset selected according to a given code, so as to be able to alter an electrical signal detected from the first and second electrical contacts, upon a liquid advancing along the flow path, in operation of the device.

22. The method according to claim 21, wherein the material spots deposited comprise a first plurality of spots that are soluble in a given liquid and a second plurality of spots that are not soluble in said given liquid.

23. The method according to claim 21, wherein in the device provided, said first and second sensing portions form an arrangement of successive parts along the flow path, and at depositing said material spots, no material spot is deposited on any sensing portions of an upstream subset of the first and second sensing portions of said arrangement.

* * * * *